US006672695B1

(12) United States Patent
Naka et al.

(10) Patent No.: US 6,672,695 B1
(45) Date of Patent: Jan. 6, 2004

(54) INK CARTRIDGE MANAGEMENT SYSTEM, PRINTER, AND INK CARTRIDGE

(75) Inventors: Takahiro Naka, Nagano (JP); Hiroaki Tojyo, Nagano (JP); Toshihisa Saruta, Nagano (JP); Satoshi Shinada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 611 days.

(21) Appl. No.: 09/653,346

(22) Filed: Aug. 31, 2000

(30) Foreign Application Priority Data

| | | |
|---|---|---|
| Aug. 31, 1999 | (JP) | P 11-245388 |
| Sep. 1, 1999 | (JP) | P 11-246907 |
| Sep. 1, 1999 | (JP) | P 11-246952 |
| Sep. 1, 1999 | (JP) | P 11-247325 |

(51) Int. Cl.[7] ..... B41J 2/195; B41J 29/393
(52) U.S. Cl. ..... 347/7; 347/19
(58) Field of Search ..... 347/7, 14, 19, 347/23; 399/24, 27, 29

(56) References Cited

U.S. PATENT DOCUMENTS 5,802,420 A * 9/1998 Garr et al. ..... 399/27

FOREIGN PATENT DOCUMENTS

WO 98/52762 11/1998 ..... B41J/2/01

* cited by examiner

*Primary Examiner*—Juanita Stephens
(74) *Attorney, Agent, or Firm*—Sughrue Mion, PLLC

(57) ABSTRACT

An ink cartridge placed in an ink jet printer stores cartridge management data containing "ink capacity", "ink total consumption amount", and "cartridge identification information". A host 1 stores host management data containing "ink total consumption amount" and cartridge identification information for each cartridge. The host collates the cartridge management data read by the printer 5 with the host management data stored in the host 1 and determines the precise "ink total consumption amount." After print processing terminates, the printer calculates the amount of ink consumed in the print (ink consumption amount) and the host updates the "ink total consumption amount" based on the calculated ink consumption amount. The printer updates the "ink total consumption amount" recorded in the cartridge management data to the "ink total consumption amount" updated by the host.

66 Claims, 16 Drawing Sheets

INK CARTRIDGE MANAGEMENT SYSTEM, PRINTER, AND INK CARTRIDGE

BACKGROUND OF THE INVENTION

This invention relates to a technique for managing an ink cartridge placed in an ink jet printer.

To print normally, an ink jet printer manages the state of an ink cartridge, for example, the ink remaining amount. That is, the ink remaining amount in the ink cartridge is estimated based on the amount of printouts provided from the initial placement of the ink cartridge to the present. When the ink cartridge is replaced, the ink remaining amount estimated so far is reset and new estimation of the ink remaining amount is started.

In the above-described method, the ink remaining amount cannot always be estimated precisely.

For example, to remove anink cartridge placed in one printer and again place the ink cartridge in another printer for use, the printer, which resets the ink remaining amount estimated so far, recognizes the again placed ink cartridge as an initially placed ink cartridge and estimates the ink remaining amount.

Thus, the user who prints with the again placed ink cartridge cannot know the precise ink remaining amount and therefore may encounter the ink end (namely, ink remaining amount zero) at an unexpected point in the printing.

SUMMARY OF THE INVENTION

It is an object of the present invention is to provide a method of precisely determining ink remaining amount in an ink cartridge.

It is another object of the invention to make it possible to precisely manage the state of an ink cartridge even if the ink cartridge is used with different printers.

To achieve the above-noted and other objects, the present invention provides, for example, the following technical concept: That is, a serial number and so on of an ink cartridge is stored in a printer main body or a host device connected to the printer main body. Using the stored data and data of a currently mounted cartridge, the printer or host determine a precise in remaining amount in the currently mounted ink cartridge.

The present invention provides, for example, the following technical concept: That is, serial numbers of printers that have ever been used with an ink cartridge is stored in the ink cartridge, and using the stored data and data stored in a printer or host, an ink remaining amount of the ink cartridge is determined.

The present invention provides, for example, the following technical concept: That is, data stored in an ink cartridge is saved as backup data in a printer or a host when the ink cartridge is to be detached from the printer or when power for the printer on which the ink cartridge is mounted is turned off.

The present invention provides, for example, the following technical concept: That is, data stored in an ink cartridge is read when the ink cartridge is mounted to the printer or when power for the printer on which the ink cartridge is mounted is turned on. Then, the read data is compared with data stored in the printer or a host connected to the printer to determine an ink remaining amount of the ink cartridge.

The present invention provides, for example, the following technical concept: That is, data relating to ink cartridges that have ever been used together with a printer are stored in the printer or a host connected to the printer by cartridge-to-cartridge basis. When an ink cartridge or the ink cartridge is mounted to the printer, an ink remaining amount is determined using the stored data.

The present invention provides, for example, the following technical concept: That is, data relating to ink cartridges that have ever been used together with a printer are stored in the printer or a host connected to the printer by cartridge-to-cartridge basis. In storing data, the oldest data stored in the printer or host is updated with the newest data obtained in relation to the ink cartridge or an ink cartridge mounted to the printer.

The above-noted technical concepts and other technical concepts of the present invention are fully disclosed in the following description and the accompanying drawings.

The present disclosure relates to the subject matter contained in Japanese patent application Nos. Hei. 11-245388 (filed on Aug. 31, 1999), Hei. 11-246907 (filed on Sep. 1, 1999), Hei. 11-246952 (filed on Sep. 1, 1999) and Hei. 11-247325 (filed on Sep. 1, 1999), which are expressly incorporated herein by reference in their entireties.

DESCRIPTION OF THE PREFERRED EMBODIMENT

Figure 1:
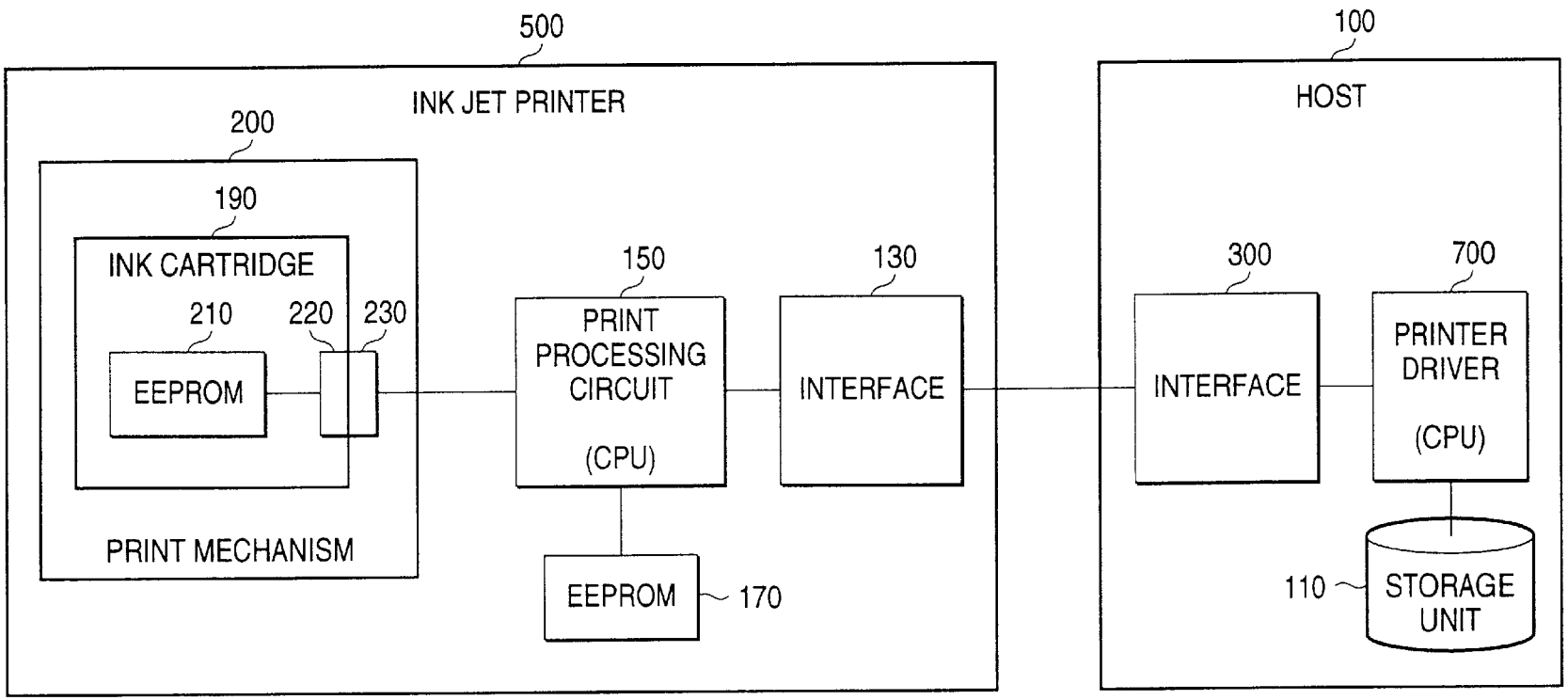
FIG. 1 is a block diagram to show a general configuration of a print system.

FIG. 1 shows a general configuration of a print system according to an embodiment of the invention.

A host 100 is connected to an ink jet printer (referred to simply as a printer) 500 via an interface circuit 300. The host 100 typically is a general-purpose computer such as a personal computer, and has a printer driver 700, i.e. a software for performing preparation processing of print data to be sent to the printer 500, and a storage unit 110 for storing various pieces of data. The printer drive 700 has not only the essential function of preparing print data and sending the data to the printer 500, but also the function of managing the ink total consumption amount (or ink remaining amount) in the ink cartridge placed in the printer 500 as described later.

The printer 500 is connected to the host 100 via an interface circuit 130. The printer 500 has a print processing circuit 150 for preparing a print image based on print data transferred via the interface circuit 130 from the host 100, and performing paper feed control, etc. The printer 500 also has a print mechanism 200 for printing the print image prepared by the print processing circuit 150 under the control of the print processing circuit 150. The print processing circuit 150 is provided with a nonvolatile storage medium for storing specific data, for example, EEPROM 170.

The print mechanism 200 is made up of a print head, a carriage, a paper feed unit, a head maintenance unit, etc. A replaceable ink cartridge (referred simply as a cartridge) 190 for supplying ink to the print head is detachably set in the print mechanism 200. The cartridge 190 has a nonvolatile storage medium, for example, EEPROM 210. With the cartridge 19 completely placed, an access terminal 220 of the EEPROM 210 is connected to a connection terminal 230 provided in the printer 500 so that the EEPROM 210 is electrically connected to the print processing circuit 150. The printer 500 may be compatible with different types of cartridges, for example, may be designed so that a type of cartridge (for example, a cartridge having a large or small ink capacity, dye or pigment ink, etc.,) can be selectively mounted thereon in accordance with a purpose of the print.

Generally, the ink cartridge types include the on-carriage type wherein the cartridge is mounted on a carriage together with a print head) and the off-carriage type wherein the cartridge is set at a fixed position free from a carriage; the cartridge 190 of the embodiment may be either type. The cartridge 190 can be used with aplurality ofprinters in sucha manner that it is placed in one printer and is used to some extent, then is removed from the printer and is again placed in another printer.

Figure 2:
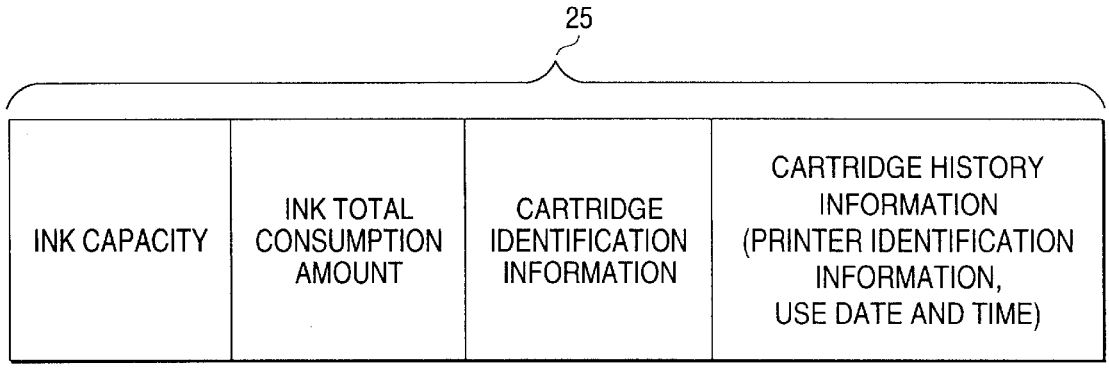
FIG. 2 is a drawing to show the data stored in EEPROM 21 of a cartridge 190.

In the embodiment, the EEPROM 210 of the cartridge 190, the EEPROM 170 of the printer 500, and the storage unit 110 of the host 100 store respective data described below:

FIG. 2 shows the data stored in the EEPROM 210 of the cartridge 190.

The EEPROM 210 of the cartridge 190 stores cartridge management data 25, which includes "ink capacity (namely, the maximum amount of available ink)" in the cartridge 19, "ink total consumption amount" indicative of the total amount of ink consumed so far, "cartridge identification information (for example, the serial manufacture number of the cartridge 190)" for uniquely identifying the cartridge 190, and "cartridge history information" indicating the use history of the cartridge 190. The "cartridge history information" includes "printer identification information (for example, the serial manufacture number of printer)" indicating the printer involved when the "ink total consumption amount" was previously updated and "use date and time (for example, 16:20 on April 4)" indicating the previous update date and time.

Figure 3:
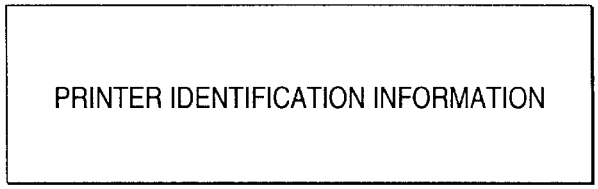
FIG. 3 is a drawing to show the data stored in EEPROM 17 of a printer 500.

FIG. 3 shows the data stored in the EEPROM 170 of the printer 500.

The EEPROM 170 of the printer 500 stores "printer identification information (for example, the serial manufacture number of the printer)" 27 for uniquely identifying the printer 500.

Figure 4:
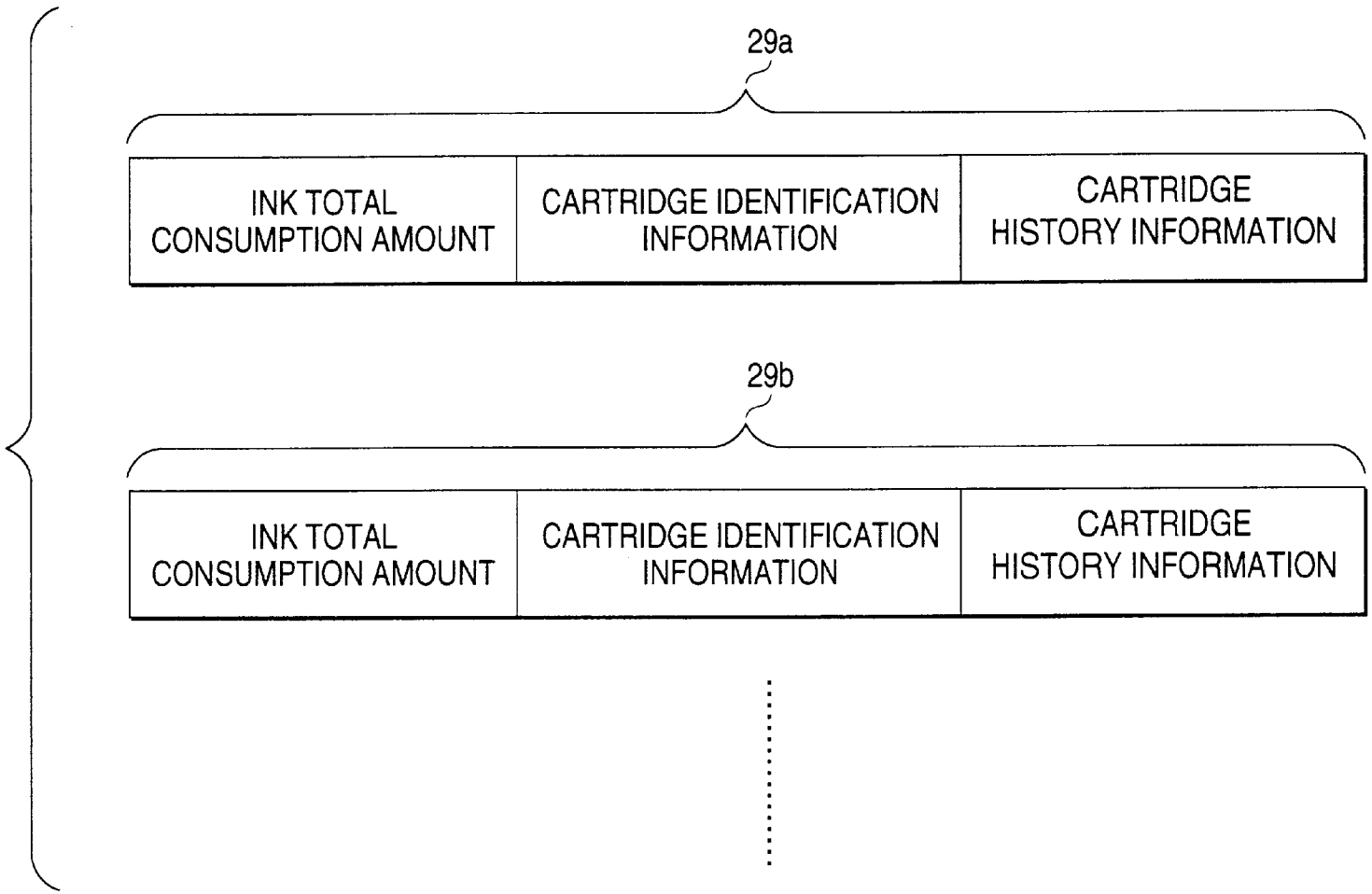
FIG. 4 is a drawing to show the data stored in a storage unit 110 of a host 100.

FIG. 4 shows the data stored in the storage unit 110 of the host 100.

The storage unit 110 of the host 100 stores host management data 29*a*, 29*b*, . . . for each cartridge, provided for the printer driver 7 to manage the cartridges separately. Each piece of the host management data 29*a*, 29*b*, . . . includes "ink total consumption amount," "cartridge identification information (for example, the serial manufacture number of the cartridge)," and "cartridge history information." The "cartridge history information" includes "printer identification information" indicating the printer involved when the "ink total consumption amount" was previously updated and "use date and time indicating the previous update date and time like the "cartridge history information" stored in the EEPROM 210 of the cartridge 190.

Figure 5:
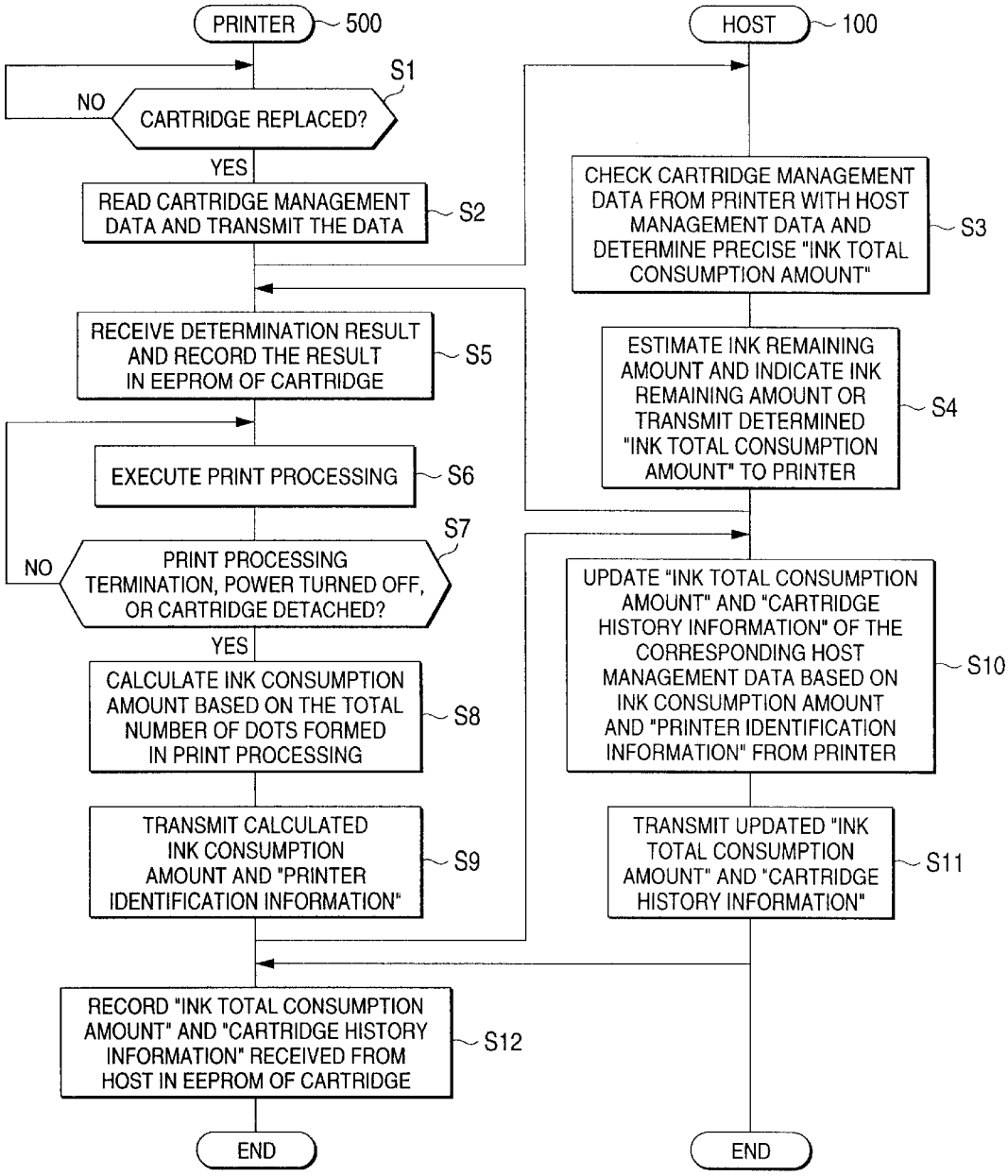
FIG. 5 is a flowchart to show the operation of the printer and the host.

A general flow of the operation of the printer 500 and the host 100 to manage the ink remaining amount in the ink cartridge 190 will be discussed with reference to FIG. 5.

When the cartridge 190 is replaced (or a new cartridge 190 is placed) (Yes at step S1), the printer 500 (strictly, the print processing circuit 150) reads the cartridge management data 25 from the EEPROM 210 of the cartridge 190 and transmits the data to the host 100 at step S2. In the step S1, the judgment may.be made as to whether or not the printer 500 is turned on.

The host 100 (strictly, the printer driver 700) collates or compares the cartridge management data.25 from the printer 500 with the host management data 29*a*, 29*b*, . . . stored in the storage unit 110, and determines the precise amount of the "ink total consumption amount" of ink consumed so far in the cartridge 190 at step S3. The host 100 refers to the "ink capacity" recorded in the cartridge management data 25, compares the "ink capacity" with the precise "ink total consumption amount" determined, estimates the ink remaining amount, indicates the ink remaining amount as requested by the user or gives an alarm to the user if the ink remaining amount is a little, and transmits the determination result of the "ink total consumption amount," etc., at step S3 to the printer 500 at step S4.

The printer 500 receives the determination result of the "ink total consumption amount" from the host 100 and records the result in the EEPROM 210 of the cartridge 190 at step S5. If a print command from the host 100 exists, the printer 500 executes print processing at step S6. When preparing a print image (binary image indicating whether or not dots are to be printed) in the print processing, the printer 500 counts the number of dots contained in the print image. Then, just after the print processing terminates or when the power of the printer 500 is turned off or the cartridge 190 is taken out (Yes at step S7), the printer 500 checks the total number of dots counted in the print processing and calculates the amount of ink consumed in the print (ink consumption.amount) based on the total number of dots at step S8. The printer 500 transmits the calculated ink consumption amount and the "printer identification information" 27 recorded in the printer 500 to the host 100 at step S9.

The host 100 updates the "ink total consumption amount" and the "cartridge history information" of the corresponding host management data in the storage unit 110 based on the calculated ink consumption amount and the "printer identification information" 27 received from the printer 500 at step S10. In more detail, the ink consumption amount received from the printer 500 is added to the precise "ink total consumption amount" determined at step S3 to find the current mink total consumption amount", and the "ink total consumption amount" recorded in the host management data is updated to the found "ink total consumption amount." The "Printer identification information" recorded in the "cartridge history information" of the host management data is updated to the "printer identification information" 27 received from the printer 500, and further the "use date and time" recorded in the "cartridge history information" is updated to the current date and time (namely, the current update date and time). The host 100 transmits the "ink total consumption amount" and the "cartridge history information" thus updated to the printer 500 at step S11.

The printer 500 receives the updated "ink total consumption amount" and "cartridge history information" from the host 100, and updates "ink total consumption amount" and the "cartridge history information" recorded in the cartridge management data 25 to the received "ink total consumption amount" and "cartridge history information" at step S12.

Figure 6:
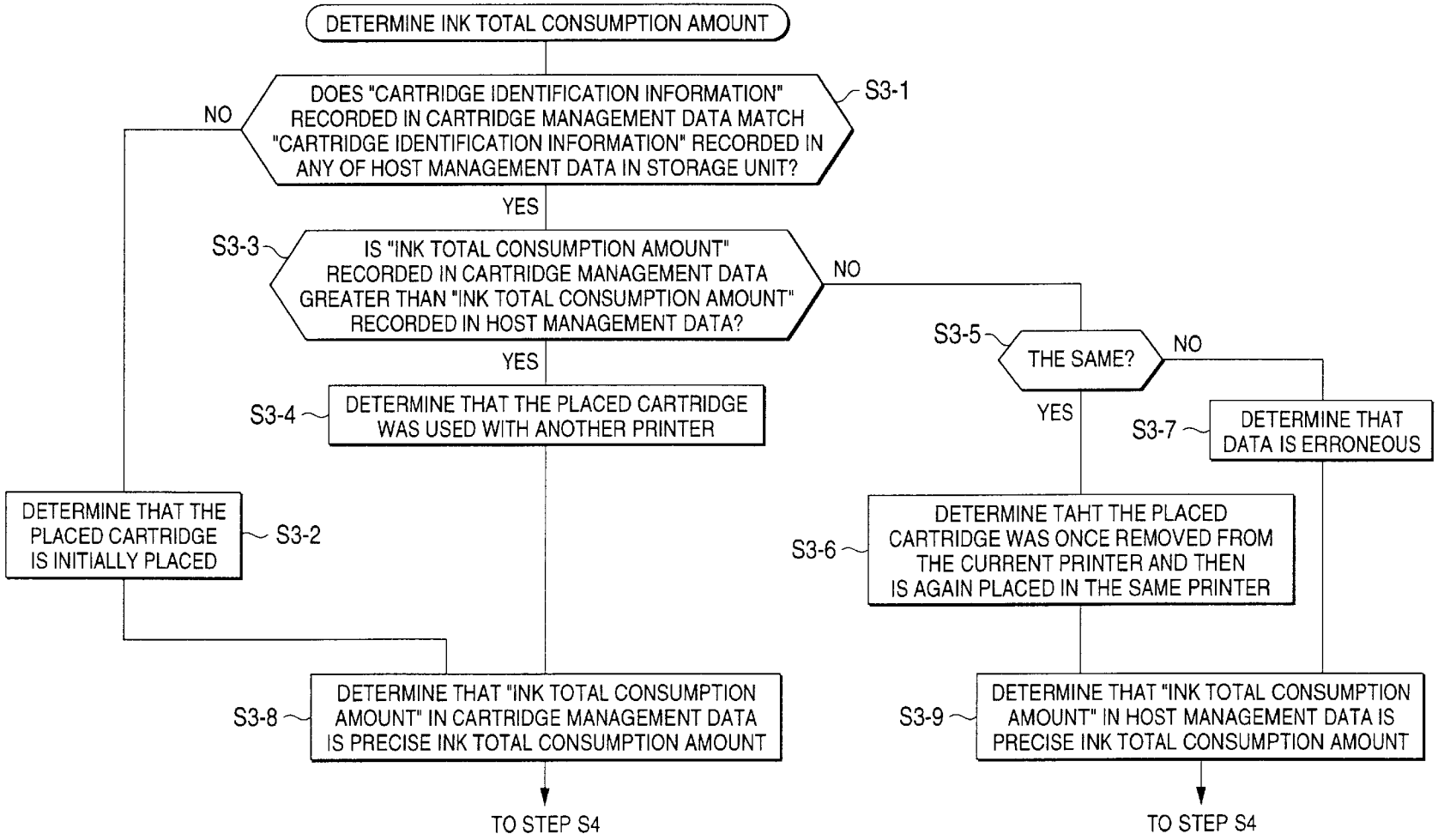
FIG. 6 is a flowchart to show the operation of the host in accordance with a first method to determine the precise "ink total consumption amount;"

A plurality of methods can be adopted for the processing of the host 100 for determining the precise "ink total consumption amount" at step S3 in the operation flow. The three representative methods among them are as follows:

FIG. 6 shows a flow of the first method for the host 100 to determine the precise "ink total consumption amount."

The first method is to determine the precise ink total consumption amount using the "ink total consumption amount" and the "cartridge identification information" recorded in both the cartridge management data 25 and the host management data 29*a*, 29*b*, . . .

The host 100 first checks whether or not the "cartridge identification information" recorded in the cartridge management data 25 received from the printer 500 matches the "cartridge identification information" recorded in any of the host management data 29*a*, 29*b*, . . . in the storage unit 110 at step S3-1. If they do not match (No at step S3-1), it is determined that the currently placed cartridge 190 is initially placed in the printer 500 at step S3-2, and that the "ink total consumption, amount" recorded in the cartridge management data 25 is the precise ink total consumption amount at step S3-8.

If a match is found at step S3-1 (Yes at step S3-1), a comparison is made between the "ink total consumption amount" in the cartridge management data 25 and that in the corresponding host management data at step S3-3. If the comparison result indicates that the "ink total consumption amount" recorded in the cartridge management data 25 is greater than that in the host management data (Yes at step S3-3), it is determined that the currently placed cartridge 190 was previously used with another printer at step S3-4, and the "ink total consumption amount" in the cartridge management data 25 is determined to be the precise value at step S3-8.

If the comparison result at step S3-3 indicates that the "ink total consumption amount" in the cartridge management data 25 is the same as that in the host management data (Yes at step S35), it is determined that the currently placed cartridge 190 was once removed from the printer 500 and then is again placed in the same printer (without being used with another printer) at step S3-6, and the "ink total consumption amount" in the host management, data is determined to be precise at step S3-9. In this case, either the cartridge management data or the host management data may be used. However, if the number of bits of the cartridge management data is fewer than that of the host management data to reduce the memory capacity in the cartridge, it is advantageous to use the host management data.

If the comparison result at step S3-3 indicates that the "ink total consumption amount" in the cartridge management data 25 is less than that in the host management data (No at step S3-5), it is determined that the cartridge management data is erroneous (for example, an error occurred in the previous "ink total consumption amount" update) at step S3-7, and the "ink total consumption amount" in the host management data is determined to be precise at step S3-9.

Figure 7:
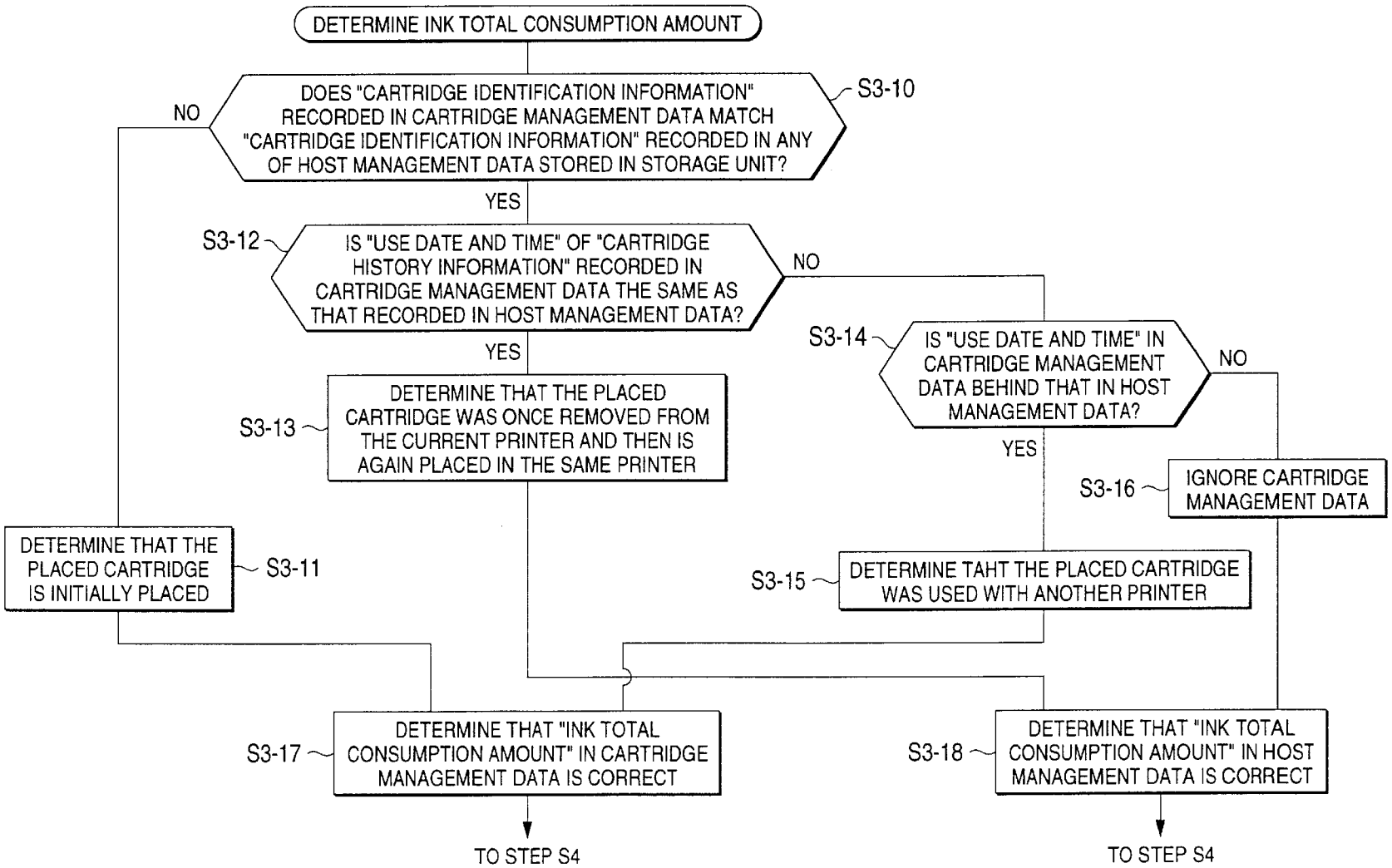
FIG. 7 is a flowchart to show the operation of the host in accordance with a second method to determine the precise "ink total consumption amount;"

FIG. 7 shows a flow of the second method to determine the precise "ink total consumption amount."

The second method is to determine the precise ink total consumption amount using the "ink total consumption amount" and the "use date and time" recorded in both the cartridge management data 25 and the host management data 29*a*, 29*b*, . . .

The host 100 first performs similar operation to that at step S3-1 shown in FIG. 3 at step S3-10, then makes a comparison between the "use date and time" in the cartridge management data 25 and that in the corresponding host management data to check whether or not they are the same at step S3-12. If they are the same (Yes at step S3-12), it is determined that the currently placed cartridge 190 was once removed from the printer 500 and then is again placed in the same printer (without being used with another printer) at step S3-13, and the "ink total consumption amount" in the host management data is determined to be precise at step S3-18.

If the result at step S3-12 indicates that the "use date and time" in the cartridge management data 25 differs from that in the host management data (No at step S3-12), whether or not the "use date and time" in the cartridge management data 25 is behind (postdates) that in the host management data is checked at step S3-14. If so (Yes at step S3-14), it is determined that the currently placed cartridge 190 was previously used with another printer at step S3-15, and the "ink total consumption amount" in the cartridge management data 25 is determined to be precise at step S3-17. If the result. at step S3-14 indicates that the "use date and time" in the cartridge management data 25 is ahead (antedates) that in the.host management data (No at step S3-14), it is possible that the cartridge management data 25 is erroneous. Then, the cartridge management data 25 is ignored at step S3-16 and the "ink total consumption amount" in the host management data is determined to be precise at step S3-18.

Figure 8:
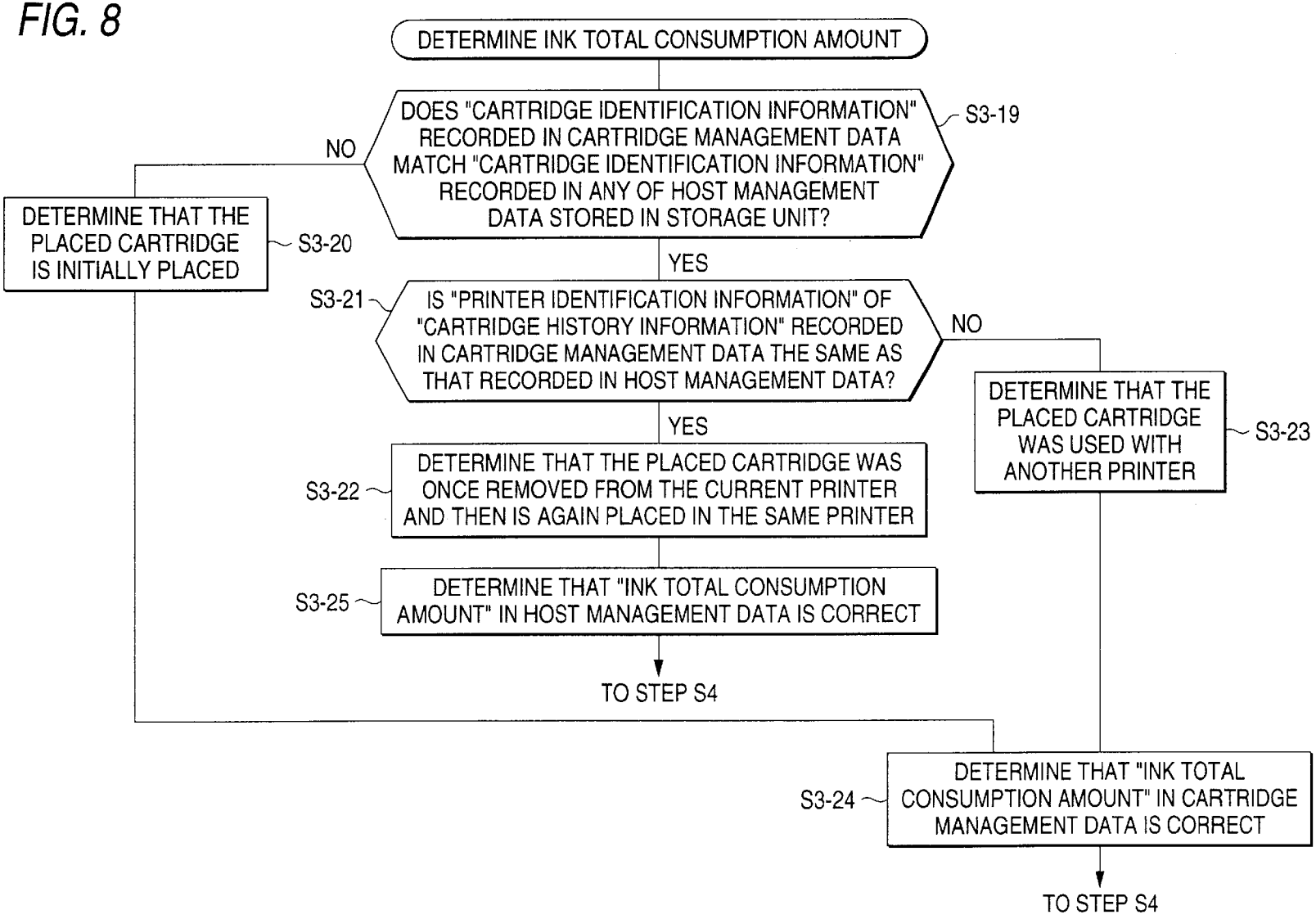
FIG. 8 is a flowchart to show the operation of the host in accordance with a third method to determine the precise "ink total consumption amount"

FIG. 8 shows a flow of the third method to determine the precise "ink total consumption amount."

The third method is to determine the precise ink total consumption amount using the "ink total consumption amount" and the "printer identification information" recorded in both the cartridge management data 25 and the host management data 29*a*, 29*b*, . . .

The host 100 first performs similar operation to that at step S3-1 shown in FIG. 3 at step S3-19, then makes a comparison between the "printer identification information" in the cartridge management data 25 and that in the corresponding host management data to check whether or not they are the same at step S3-21. If they are the same (Yes at step S3-21), it is determined that the currently placed cartridge 190 was once removed from the printer 500 and then is again placed in the same printer (without being used with another printer) at step S3-22, and the "ink total consumption amount" in the host management data is determined to be precise at step S3-25.

If the result at step S3-21 indicates that the "printer. identification information" in the cartridge management data 25 differs from that in the host management data (No at step S3-21), it is determined that the currently placed cartridge 190 was previously used with another printer at step S3-23, and the "ink total consumption amount" in the cartridge management data 25 is determined to be precise at step S3-24.

The host 100 determines the precise "ink total consumption amount" by any of the first to third methods. At step S4 in FIG. 5, the host 100 compares the precise "ink total consumption amount" with the "ink capacity" in the cartridge management data 25 and estimates the ink remaining amount. When the ink remaining amount is a little, for example, the host 100 can inform the user of that fact (ink near end), or can control the printer 5 in accordance with the ink remaining amount.

In the embodiment, just before the cartridge 190 is detached from the printer 500, the host 100 or the printer 500 records the date and time. Then, when the same cartridge 190 is again placed, how much time has elapsed since the detachment time is calculated and the contents of the print head recovery operation (ink suction time, ink suction amount,ink suction speed, etc.,) are controlled in accordance with the elapsed time. If the cartridge 190 remains detached without being placed in any printer for a long time, there is apossibility thatthe ink in the cartridge 190 maybe degraded. This control for the recovery operation makes it possible to provide the proper recovery operation in accordance with the degradation degree.

According to the above-described embodiment, both the cartridge 190 and the host 100 store the "ink total consumption amount" and the "cartridge history information" of the cartridge 190. The host 100 can make a comparison between the "ink total consumption amount" and the "cartridge history information" stored in one and those stored in the other, thereby determining that the cartridge 190 is initially used, that the cartridge 190 was once detached from the printer and is again placed in the same printer (without being used with another printer), or that the cartridge 190 was used with another printer. Thus, even if the cartridge 190 is used with a plurality of printers in such a manner that it is removed from one printer during printing and is used with another printer, then is placed in the former printer for use, the host 100 can recognize the use history of the cartridge 190, and thus can always estimate the precise "ink total consumption amount," namely, the ink remaining amount.

The host 100 stores the "ink total consumption amount" and the "cartridge history information" and performs processing of determining the precise "ink total consumption amount" and estimating the ink remaining amount. The printer 500 mainly transfers data between the host 100 and the cartridge 190 simply. Thus, the printer 500 need not have a high-performance CPU and may have a small storage capacity, so that the price of the printer 500 can be brought down. If the specifications of the cartridge 190 are changed in the future (for example, if the capacity is made large from the viewpoint of prolonging the ink life or the capacity is made small from the viewpoint of reduction in costs, weight, etc.,), the printer driver of software is upgraded and delivered to the user so as to support use of a new cartridge, whereby the ink remaining amounts of the cartridges of the new version can be managed precisely.

Although the invention has been described with reference to the preferred embodiments thereof, these embodiments are simply examples for explaining the invention, and the invention should not be restricted thereto or thereby. The invention can be practiced in various forms and embodiments without departing from the spirit and scope of the invention. For example, the "ink total consumption amount" and the "cartridge history information" in the cartridge management data 25 or the host management data 29*a*, 29*b*, . . . are not updated and may be additionally registered correspondingly to the use of the cartridge 190. This makes it possible to check the use history of the cartridge 19 from the new product to the present. The printer 500 may also store the host management data 29*a*, 29*b*, . . . and determine the ink total consumption amount. The host 100 or the printer 500 can be also provided with optimum print control information for each type of cartridge 190, whereby the host 100 or the printer 500 can refers to the "cartridge identification information" of the cartridge 190 to execute optimum printing corresponding to the type of cartridge 190. The "ink remaining amount" may be recorded in place of the "ink capacity" and "ink total consumption amount." If the "printer identification information" contained in the cartridge management data is not valid, the host 100 or the printer 500 may ignore the "ink total consumption amount" contained in the cartridge management data and determine the "ink total consumption amount" in the host management data to be the current ink total consumption amount.

Figure 9:
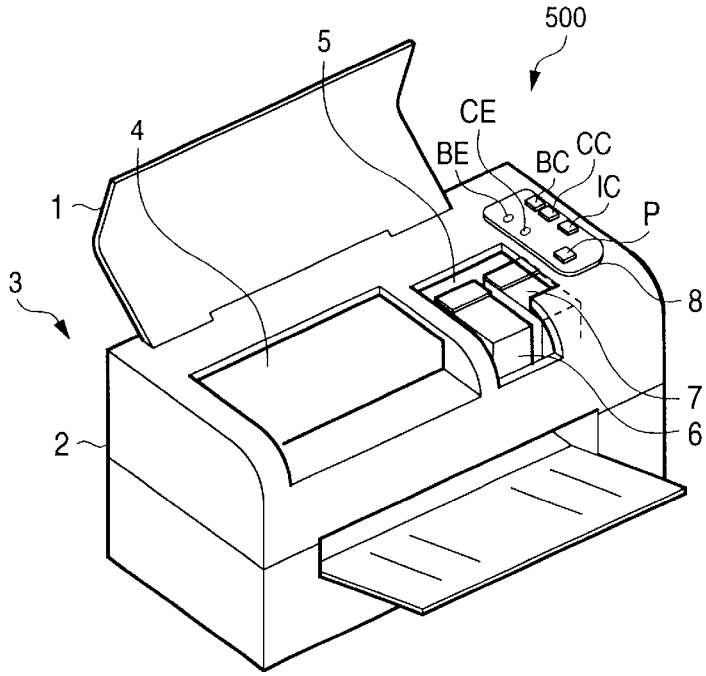
FIG. 9 is a drawing to show an embodiment of an ink jet printer.

FIG. 9 shows an example of an ink jet printer 500 to which the invention is applicable. The printer 500 includes a print mechanism (described later) housed in a case 3. The case 3 is made up of a case cover 1 that can be opened and closed, and a case main body 2. The case main body 2 is formed with a window 5 for partitioning a cartridge replacement area at a position at a distance from a print area 4.

The window 5 is sized so as to expose the entire top face of only one of two ink cartridges 6, 7 (190) mounted on a carriage 11. An operation panel 8 is provided in an area where the main body case 2 is exposed when the case cover 1 is closed. In addition to a power switch P, an ink cartridge replacement command switch IC, a black head cleaning command switch BC, and a color head cleaning command switch CC, a line feed switch, a reset switch, etc., and ink end indicators BE and CE of the black and color ink cartridges 6 and 7 are placed on the operation panel 8.

Figure 10:
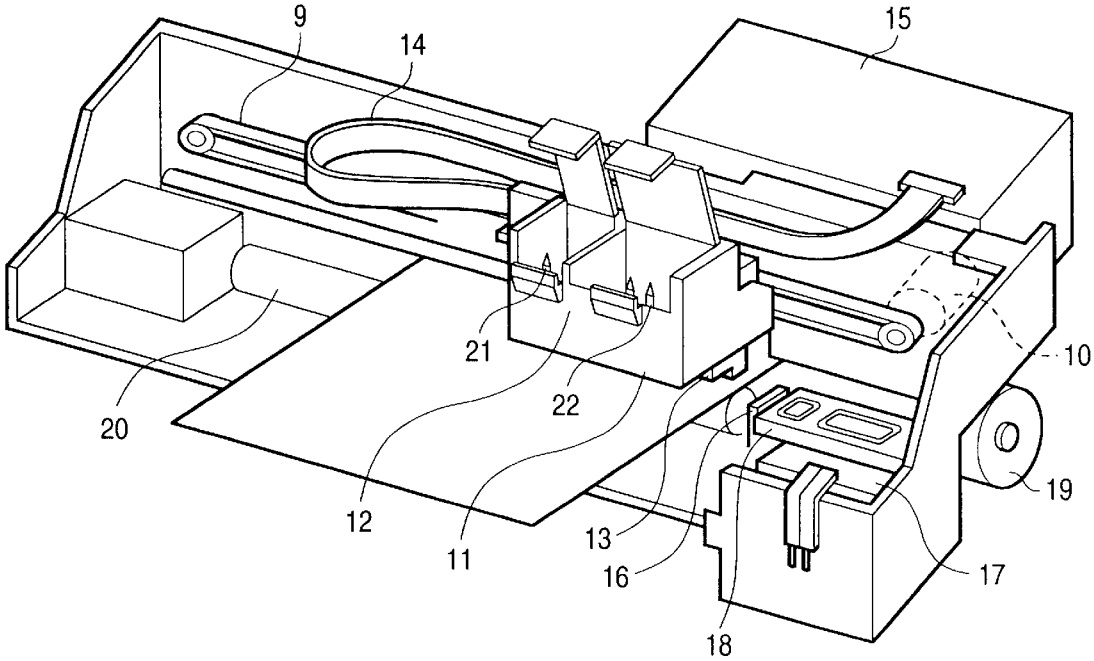
FIG. 10 is a drawing to show a print mechanism of the ink jet printer in FIG. 9.

FIG. 10 shows an example of a print mechanism of the printer shown in FIG. 9. The print mechanism in FIG. 10 is designed as the on-carriage type. A carriage 11 is connected to a drive motor 10 by a timing belt 9. The carriage 11 is formed on an upper face thereof with a holder 12 for storing a black ink cartridge 6 storing black ink and a color ink cartridge 7 storing color ink, and provided on a lower face thereof with a record head 13 for receiving supply of ink from the ink cartridges 6 and 7.

A controller 15 (described later) is connected to the carriage 11 by a flexible cable 14 to supply a print signal to the print head 13 and communicate with storage devices, such as nonvolatile storage media (210), of the ink cartridges 6 and 7.

Placed in a non-print area are a cleaning blade 16 for cleaning the record head 13 and a capping mechanism 18 for sealing the record head 13 to prevent ink from being dried and receiving supply of a negative pressure from a pump unit 17 to eliminate clogging. In FIG. 10, numeral 19 denotes a paper feed motor for driving a paper-feed roller 20 and the pump unit 17.

Figure 11A:
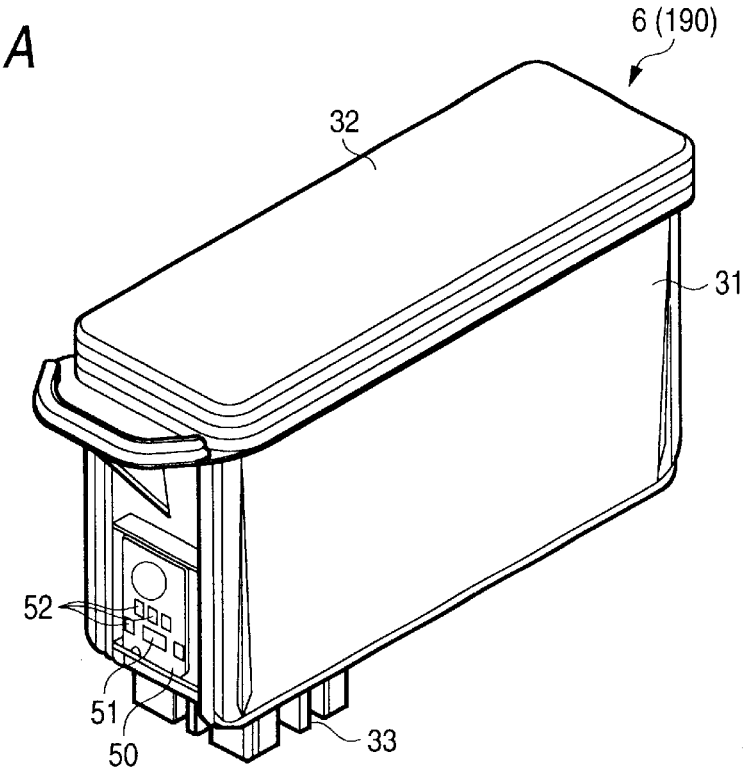
FIGS. 11A and 11B are drawings to show an embodiment of a black ink cartridge and an embodiment of a color ink cartridge used with the ink jet printer in FIG. 9.
Figure 11B:
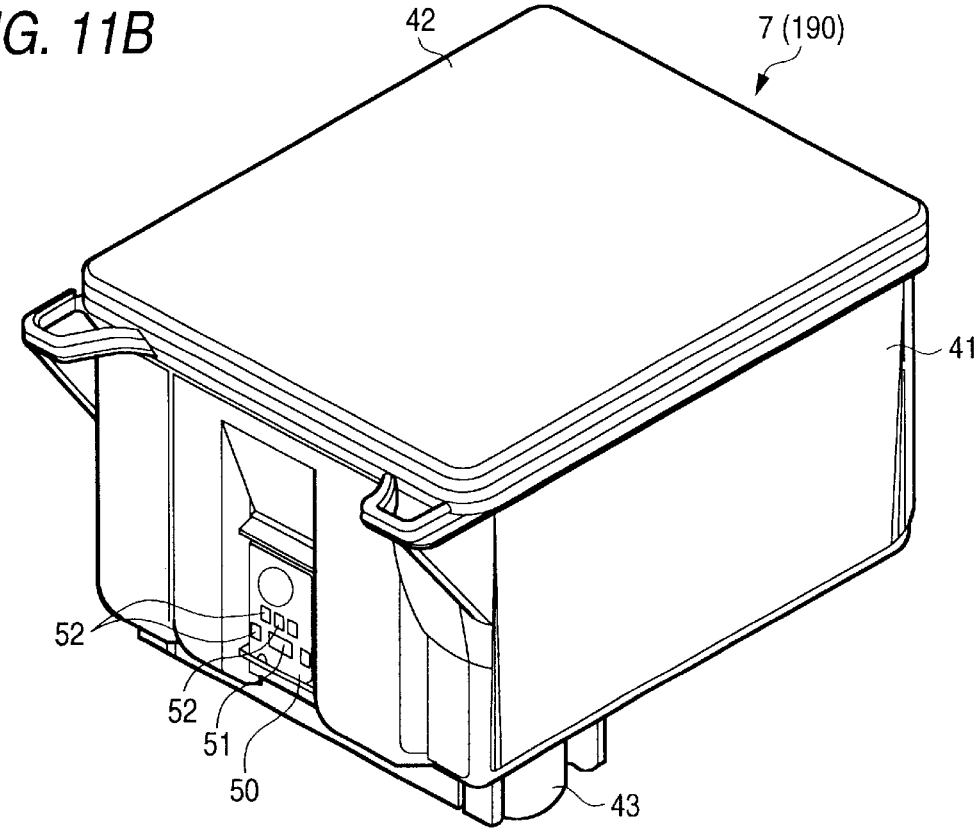

FIGS. 11A and 11B show an example of the black ink cartridge 6 (190) and an example of the color ink cartridge 7 (190). Ink is stored in a container 31, 41, and the top face of the container 31, 41 is sealed with amlid 32, 42. Ink is stored in a state in which the container 31, 41 is filled with a porous member, which is impregnated with the ink.

The container 31, 41 is formed on a bottom face thereof with an ink supply port 33, 43 air-tightly engaging an ink supply needle 21, 22 when the ink cartridge is placed in the holder 12 of the carriage 11. A circuit board 50 is fixed onto one side of the container 31, 41.

Figure 12A:
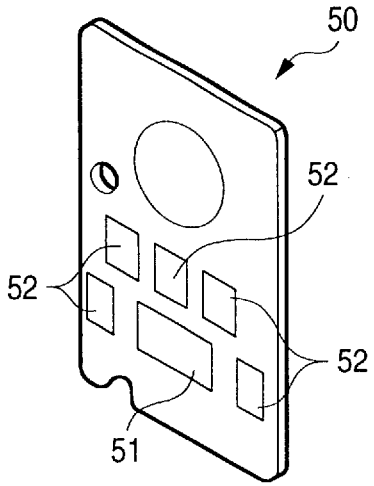
FIGS. 12A and 12B are drawings to show the surface and back structures of a circuit board attached to each of the ink cartridges in FIGS. 11A and 11B.
Figure 12B:
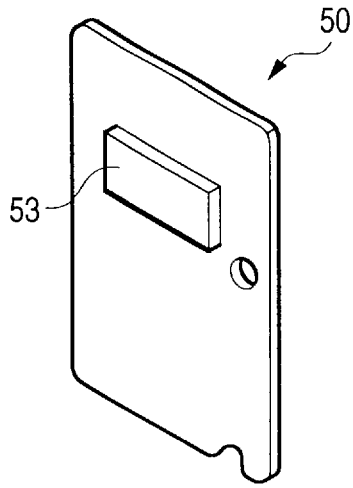
Figure 13:
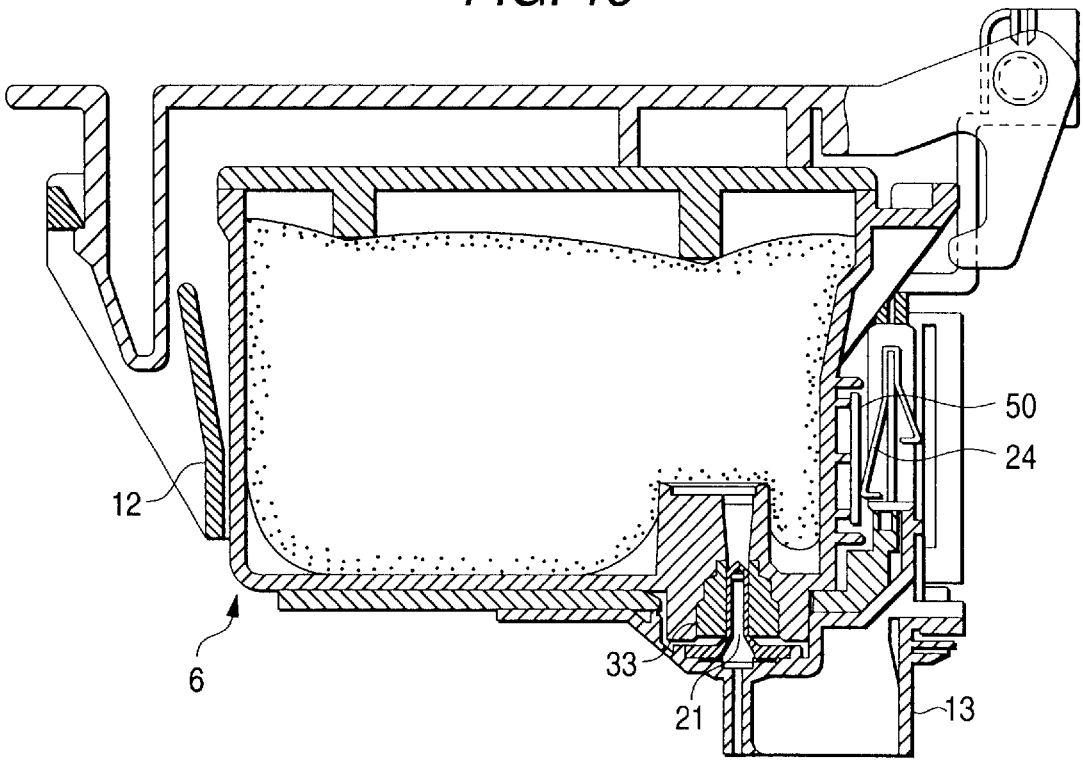
FIG. 13 is a sectional partial view of the ink jet printer with the black ink cartridge placed therein.

FIGS. 12A and 12B respectively shows a surface side of the circuit board 50 when it is attached to the ink cartridge 6, 7, and a back side opposite from the surface side. Electrodes 51 and 52 are provided on the surface side of the circuit board 50 to form contacts with a contact 24 (FIG. 13) formedon the cartridge holder 12 of the printer. The semiconductor storage device 53 is mounted on the back side in an accessible fashion.

The semiconductor storage device 53 is constructed as an electrically writable or rewritable nonvolatile memory. The serial number for identifying the ink cartridge, the ink capacity indicative of the amount of ink contained in the cartridge, the model of the ink cartridge 6, 7, and the like are previously written as "the cartridge management data" into the semiconductor storage device 53 at factory shipment. The semiconductor storage device 53 has memory areafor storing the "cartridge history information" such as the number of times the ink cartridge 6, 7 has been placed in the printer and the amount of ink consumed after the ink cartridge is placed in the printer, namely, the ink consumption amount.

Figure 14:
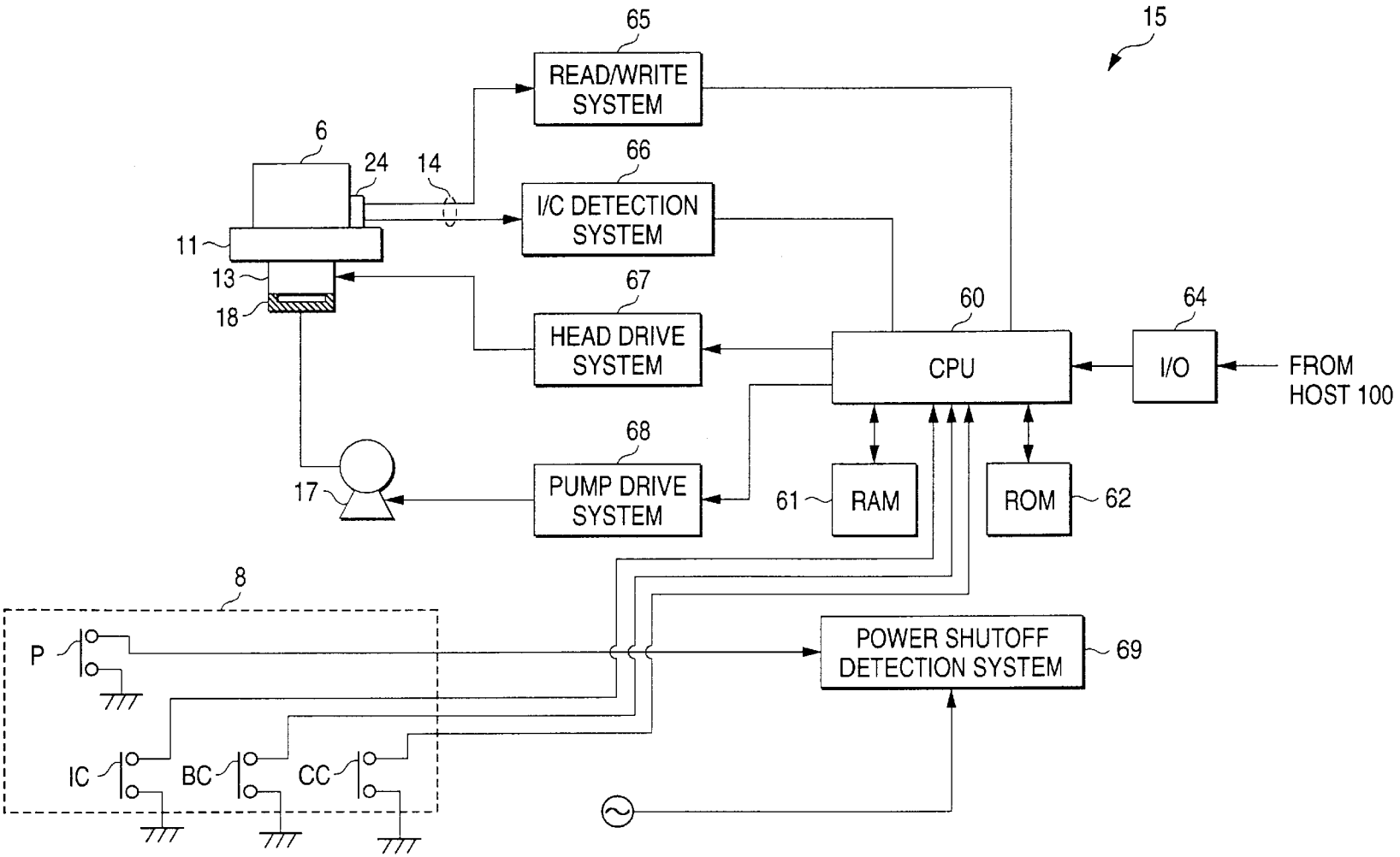
FIG. 14 is a block diagram to show an embodiment of the printer.

FIG. 14 shows an example of the above-mentioned controller 15. This controller 15 shown in FIG. 14 is designed so that the printer 500 can store the "host management data" and determine the ink total consumption amount. In the controller 15, a CPU (central processing unit) 60, RAM (random access memory) 61, and ROM (read-only memory) 62 constitutes a microcomputer, which is connected to a host 100 by an interface 64. The RAM 61 functions as work memory of the CPU 60, and is provided with an area for temporarily storing data of the ink cartridge 6, 7 read by a read/write system 65. The ROM 62 stores a control program and also is provided with a plurality of areas (in the embodiment, three areas) for storing data of the ink cartridge 6, 7 stored in the work memory as required.

An ink cartridge detection system 66 senses. whether or not the ink cartridge is placed in the printer based on the conduction state of two contacts that are electrically conducted together via the electrode 51 of a relatively large size on the circuit board 50 of the ink cartridge 6, 7. That is, if the ink cartridge is placed in the printer, a conduction path is formed, and if the ink cartridge is not placed in the printer, a conduction path is broken, and the ink cartridge detection system 66 detects the presence or absence of the conduction path to determine whether or not the ink cartridge is placed.

The printer thus constructed outputs a drive signal to the record head 13 by a head drive system 67 based on print data from the host to eject ink droplets. In a case where an operation command of ink droplet ejection recovery is given tbrough the cleaning switch, the printer actuates the pump unit 17 by a pump drive system 68 to forcibly discharge ink from the record head 13.

In FIG. 14, numeral 69 denotes a power shutoff system for supplying power from operating of the power switch P on the operation panel 8 to completion of termination processing of the printer, then shutting off the commercial power.

Figure 15:
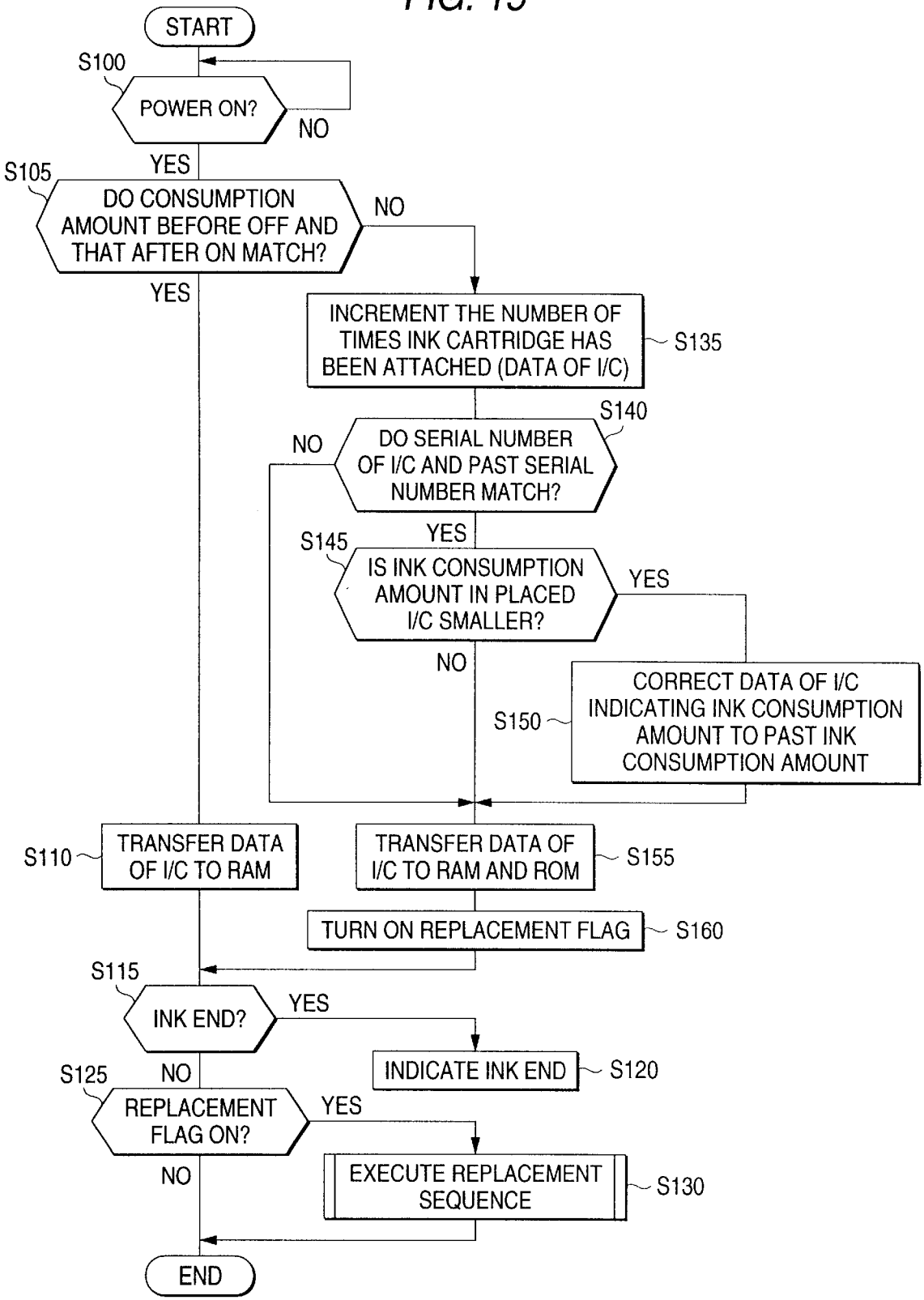
FIG. 15 is a flowchart to show a data check operation in storage system of ink cartridge when the power is turned on in the operation of the printer.

With reference to FIG. 15, a flow of a fourth method to determine the precise "ink consumption amount" will be discussed.

Figure 16A:
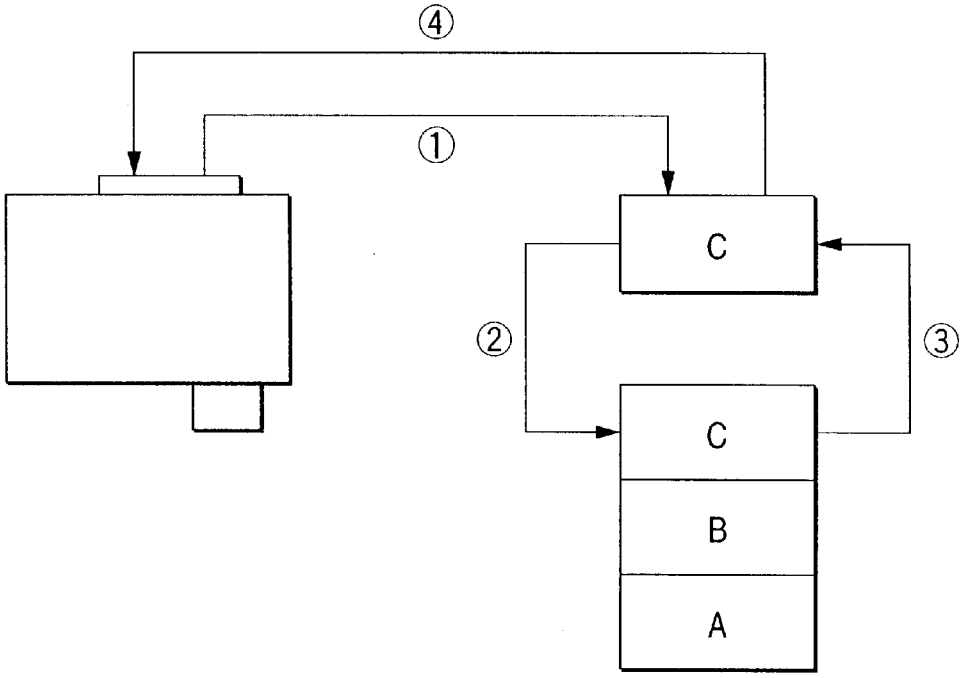
FIGS. 16A and 16B are drawings to schematically show a flow of data concerning the ink remaining amount in the printer.

When the power switch P is operated for turning. on the power at step S100, the ink consumption amount of the ink cartridge 6, 7 saved in the ROM 62 at the previous power off time is read into. the RAM 61 ((3) in FIG. 16A), and the data of the ink consumption amount is read from the storage device 53 of the ink cartridge 6, 7 ((1) in FIG. 16A), then a comparison is made therebetween.

If they match as a result of the comparison at step S105, the ink consumption amount data stored in the storage device 53 of the ink cartridge 6, 7 is transferred to the RAM 61 at step S110 ((1) in FIG. 16A). Other data stored in the storage device 53 of the ink cartridge 6, 7, for example, the data for identifying the corresponding ink cartridge 6 or 7 are also transferred as required.

When the ink use amount has been stored in the RAM 61 of the printer main unit, it is determined at step S115 as to whether or not the amount of ink consumed so far is such an extent that the remaining ink amount is sufficient for subsequent print (whether or not the ink remains sufficiently for subsequent print even after a replacement sequence is carried out). If the ink end is determined, the ink end is indicated, prompting the user to replace the ink cartridge 6, 7 at step S120.

On the other hand, if the ink remaining amount is sufficient for the subsequent print, the presence or absence of an ink cartridge replacement flag is detected at step S125. If the ink cartridge replacement flag is turned on as a result of the replacement of ink cartridge 6, 7, the replacement sequence is executed at step S130.

If a match is not found as a result of the comparison with the ink consumption amount stored in the ROM 62 at step S105, it is determined that while the power is off, the ink cartridge 6, 7 is replaced or is removed, then is placed in and used with a different printer to execute print, and is again placed in the former printer, and the number of times the ink cartridge 6, 7 has been attached is incremented at step S135 and the result is stored in the storage device 53 of the ink cartridge 6, 7.

The serial number of the currently placed ink cartridge 6, 7, which is stored in the storage device 53, is compared with the serial numbers that indicates ink cartridges 6, 7 placed in the past and that are stored in the ROM 62. If a match is found regarding the serial number at step S140, it is determined that the ink cartridge 6, 7 is again placed in the printer, and the ink consumption amount of the ink cartridge 6, 7, which is stored in the storage device 53, is compared with that stored in the ROM 62. If the ink consumption amount stored in the ROM 62 is greater at step S145, the ink consumption amount stored in the ROM 62 is transferred to the storage device 53 of the ink cartridge 6, 7 and is rewritten into the storage device 53 at step 150 ((3) and (4) in FIG. 16A).

If the ink remaining amount is detected and the ink end is found just before step S140 is executed, the ink end may be indicated and the later steps from S140 to S130 may be skipped in order to eliminate meaningless data rewrite in the ROM 62 and save only necessary data. This makes is possible to efficiently save the necessary data for managing the ink remaining amount using a minimal memory capacity.

Figure 16B:
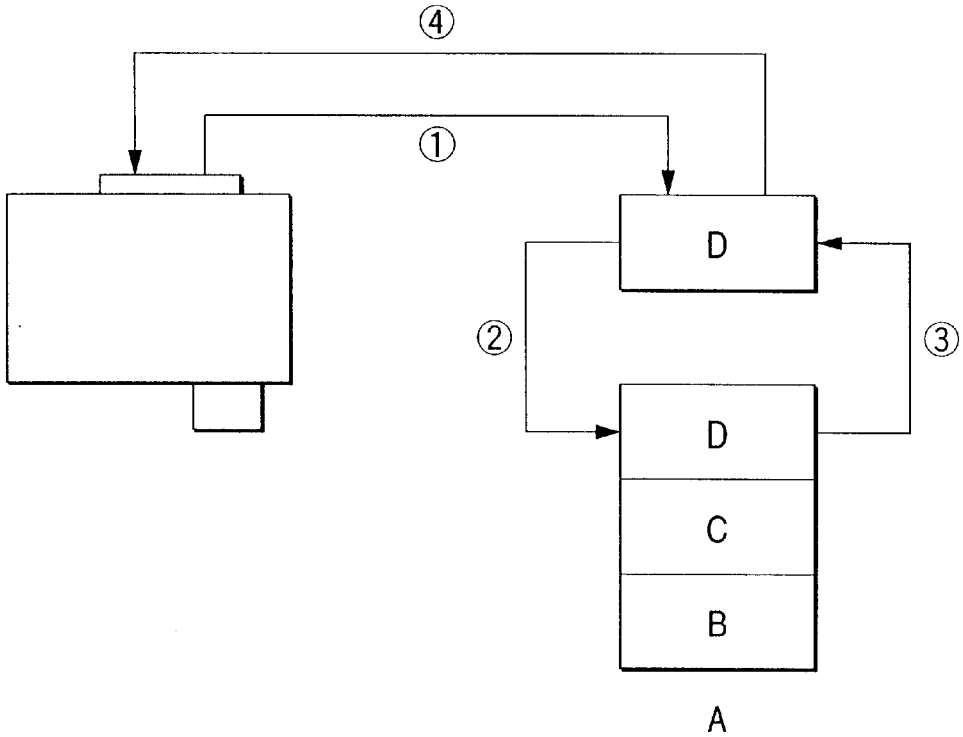

When the ink consumption amount stored in the storage device 53 of the ink cartridge 6, 7 has been thus corrected depending on the ink consumption amount stored in the ROM 62 and other data have been corrected as required, the serial number and the ink consumption amount stored in the storage device 53 of the ink cartridge 6, 7 are transferred to the RAM 61 and the ROM 62 at step S155. In the ROM 62, the oldest data A (FIG. 16B) is deleted and data D concerning the ink cartridge 6, 7 transferred via the RAM 61 is stored.

In a case where the serial numbers differ, it is determined that the ink cartridge 6, 7 has been replaced, and the replacement flag is turned on at step S160.

Further, it is detected at step S115 as to whether or not the amount of ink consumed so far is such an extent that the remaining ink amount is sufficient for the subsequent print (even after the replacement sequence is carried out). If the ink end is detected, the ink end is indicated, prompting the user to replace the ink cartridge 6, 7 at step S120.

On the other hand, if the ink remaining amount is sufficient for the subsequent print, the presence or absence of an ink cartridge replacement flag is detected at step S125. If the ink cartridge 6, 7 is replaced and consequently the ink cartridge replacement flag is turned on, the replacement sequence is executed at step S130.

The replacement sequence is as follows: The carriage 11 is moved to a capping position, the record head is capped by the capping system 18, the suction force and the suction time of the pump unit 17 are controlled by the pump drive system 68, and ink is forcibly discharged at the suction pressure and for the time fitted to the structure conditions of the number of nozzles, the nozzle diameter, etc., of the record head 13 placed in the printer and the ink properties of the ink viscosity, etc., of the ink cartridge 6, 7. In a case of the initial placement, the product transport liquid filled in the record head is discharged therefrom together with the ink. In case of the replacement, air bubbles, etc., entering the record head.13 in association with the detachment and attachment of the ink cartridge 6, 7 are discharged therefrom together with ink. In this fashion, the ink is discharged while filling the record head 13 with ink. After the filling of the record head 13 with ink is completed, print can be executed.

In the above-described fourth method, the data stored in the semiconductor storage device 53 of the ink cartridge is checked when the power is turned on, but may be checked when the ink cartridge is replaced.

Figure 17:
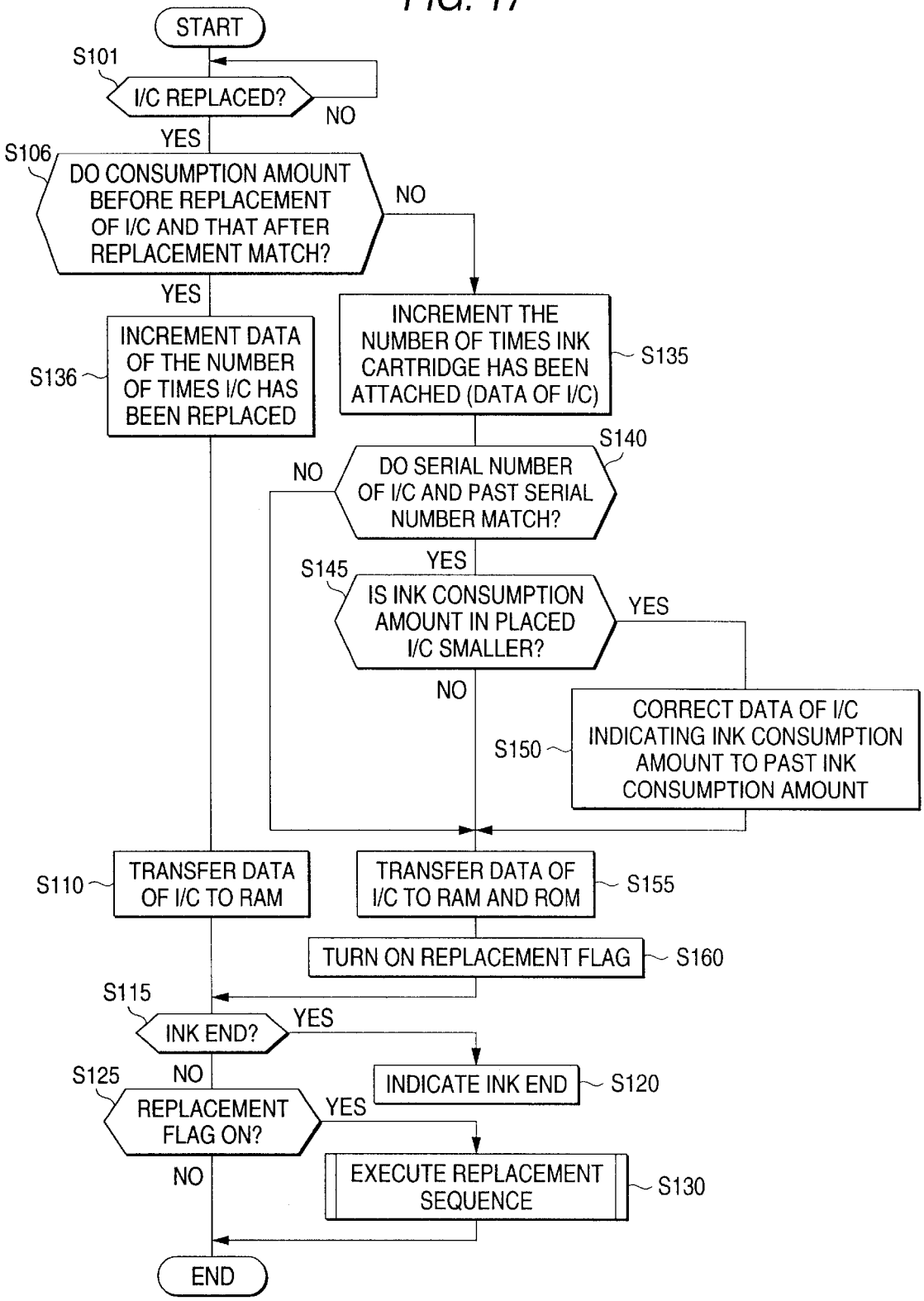
FIG. 17 is a flowchart to show the operation at the ink cartridge replacement time in the operation of the printer.

FIG. 17 shows a flow of a fifth method to determine the precise "ink consumption amount".

As shown in FIG. 9, when the ink cartridge replacement command switch IC is operated to issue an ink cartridge replacement command at step S101, the ink consumption amount of the ink cartridge 6, 7 saved in the ROM 62 before the ink cartridge is replaced is read into the RAM 61 ((3) in FIG. 16A), and the data of the ink consumption amount is read from the storage device 53 of the ink cartridge 6, 7 ((1) in FIG. 16A), then a comparison is made therebetween.

If they match as a result of the comparison at step S106, the number of times the ink cartridge 6, 7 has been replaced, stored in the semiconductor storage device 53 of the ink cartridge is incremented and the result is stored in the storage device 53 of the ink cartridge 6, 7 at step S136, and the ink consumption amount data stored in the storage device 53 of the ink cartridge 6, 7 is transferred to the RAM 61 at step S110 ((1) in FIG. 16A). Other data stored in the storage device 53 of the ink cartridge 6, 7, for example, the data for identifying the ink cartridge 6 or 7 are also transferred as required.

When the ink use amount has been stored in the RAM 61 of the printer main unit, whether or not the amount of ink consumed so far is such an extent that the ink remaining amount is sufficient for the subsequent print at step S115. If the ink end is reached, the ink end is indicated, prompting the user to replace the ink cartridge 6, 7 at step S120.

If the ink remaining amount is sufficient for the subsequent print, the presence or absence of an ink cartridge replacement flag is detected at step S125. If the ink cartridge 6, 7 is replaced and consequently the ink cartridge replacement flag is turned on, the replacement sequence is executed at step S130.

On the other hand, if a match is not found as a result of the comparison with the ink consumption amount stored in the ROM 62 at step S106, the number of times the ink cartridge 6, 7 has been attached is incremented and the result is stored in the storage device 53 of the ink cartridge 6, 7 at step S135.

The serial number of the ink cartridge 6, 7, which is stored in the storage device 53, is compared with the serial numbers of the ink cartridges 6, 7 placed in the past, which are stored in the ROM 62. If a match is found regarding the serial numbers at step S140, it is determined that the ink cartridge 6, 7 is again placed in the printer, and the ink consumption amount in the ink cartridge 6, 7 is compared with that stored in the ROM 62. If the ink consumption amount stored in the ROM 62 is greater at step S145, the ink consumption amount stored in the ROM 62 is transferred to the storage device 53 of the ink cartridge 6, 7 and is rewritten into the storage device 53 at step S150 ((3) and (4) in FIG. 16A).

When the ink remaining amount is detected and the ink end is found just before step S135 is executed, the ink end may be indicated and the later steps from S140 to S130 may be skipped. This makes it possible to eliminate meaningless data rewrite in the ROM 62 and save only necessary data, thereby making it possible to efficiently save the necessary data for managing the ink remaining amount can be saved efficiently using a minimal memory capacity.

When the ink consumption amount stored in the storage device 53 of the ink cartridge 6, 7 has been thus corrected depending on the ink consumption amount stored in the ROM 62 and other data have been corrected as required, the serial number and the ink consumption amount stored in the storage device 53 of the ink cartridge 6, 7 are transferred to the RAM 61 and the ROM 62 at step S155. In the ROM 62, the oldest data A (FIG. 16B) is deleted and data D concerning the ink cartridge 6, 7 transferred via the RAM 61 is stored.

In a case where the serial numbers differ, it is determined that the ink cartridge 6, 7 has been replaced, and the replacement flag is turned on at step S150.

Whether or not the amount of ink consumed so far is such an extent that the remaining ink amount is sufficient for the subsequent print is detected at step S115. If the ink end is detected, the ink end is indicated, prompting the user to replace the ink cartridge 6, 7 at step S120.

On the other hand, if the ink remaining amount is sufficient for the subsequent print, the presence or absence of an ink cartridge replacement flag is detected at step S125. If the ink cartridge 6, 7 is replaced and consequently the ink cartridge replacement flag is turned on, the above-described replacement sequence is executed at step S130.

According to the fifth method, if even if the same ink cartridge is once removed from one printer and is again placed in the printer after ink is consumed in another printer, the ink remaining amount can be managed precisely.

In the above-described fourth and fifth methods, the ink consumption amount indicating the amount of ink consumed or used after the ink cartridge is placed in the printer is stored; however, since the amount of ink initially stored in the ink cartridge at the factory shipment is constant, it is clear that a similar advantage can also be provided if the ink remaining amount in the cartridgeis stored.

As described above, just after the power is turned on or just after ink cartridge replacement, data concerning an ink remaining amount stored in a storage device of a currently placed ink cartridge are compared with data concerning an ink remaining amount of an ink cartridge placed just before the previous power off time or before ink cartridge replacement, stored in a cartridge data storage device of a printer main unit, and the data concerning the ink remaining amount in the storage device of the ink cartridge are corrected. Accordingly, the data concerning the ink remaining amount can be made reliable even if the semiconductor storage device of the ink cartridge is comparatively weak in data protection. It is possible to eliminate an ink consumption operation with an empty ink cartridge, which otherwise causes a large amount of air to flow into the record head.

In the fourth method, data concerning the ink remaining amount, stored in the storage device of the cartridge are checked using data concerning the ink remaining amount, stored in the storage device of the printer, at step S105 immediately after the power is turned on. This step 105 may be omitted.

Figure 18:
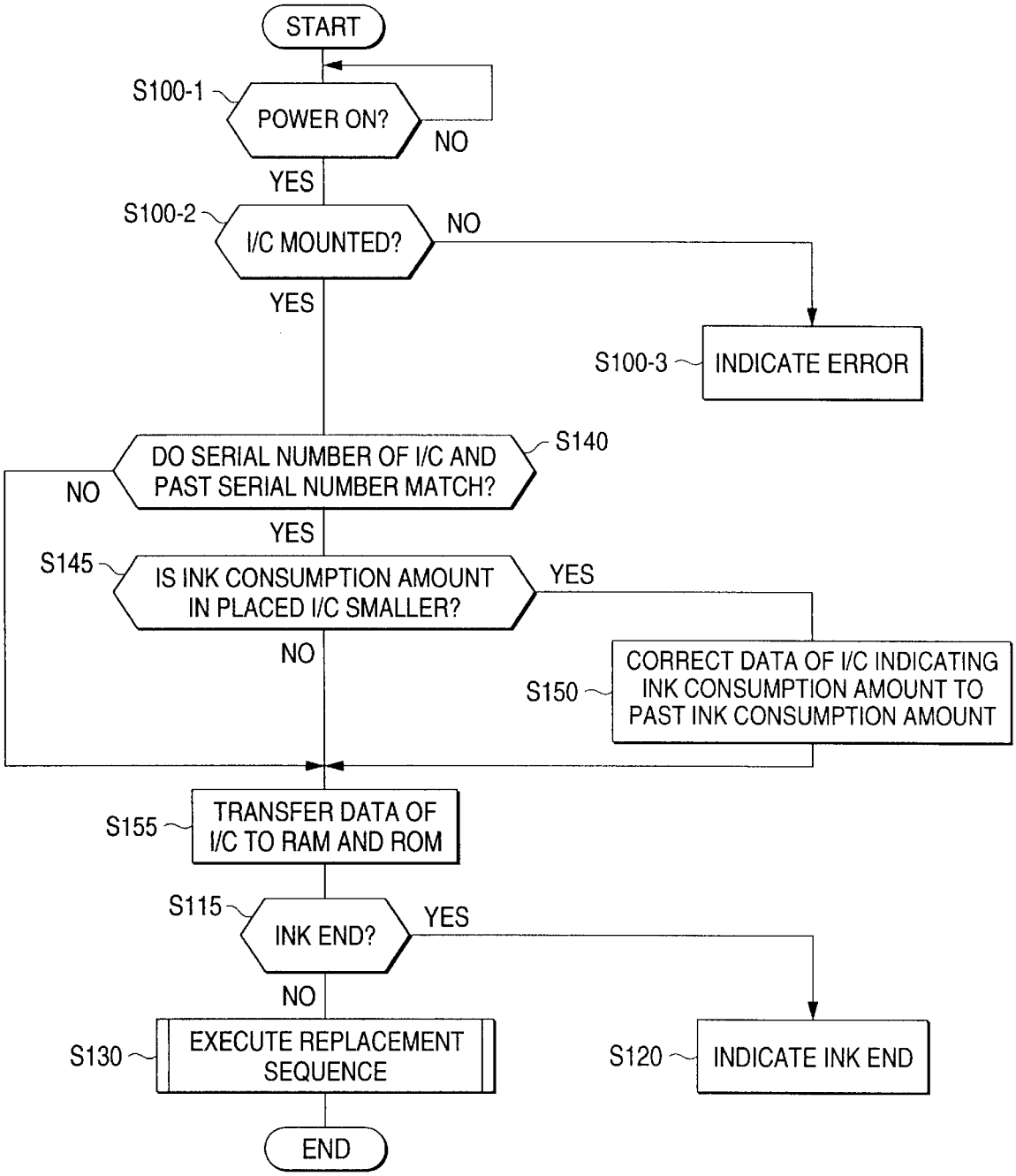
FIG. 18. is a flowchart to show another data check operation when the power is turned on in the operation of the printer.

FIG. 18 shows a flow of a sixth method to determined the precise "ink consumption amount" in which the step 105 is omitted. In the sixth method, the step 100 is divided into plural sub-steps S100-1, S100-2 and S100-3. At the step 100-1, it is detected as to whether or not the power is turned on. At the step S100-2, it is detected whether or not the presence or absence of the ink cartridge 6, 7 is detected. If it is detected at step S100-2 that the ink cartridge 6, 7 is not placed in the printer, an error is displayed at step 100-3 to inform a user that the ink cartridge 6, 7 should be placed. After the presence of the ink cartridge is confirmed at the step 100-2, the same steps S140, S145, S150, S155, S115, S120 and/or S130 as those of the fourth method are executed.

Figure 19:
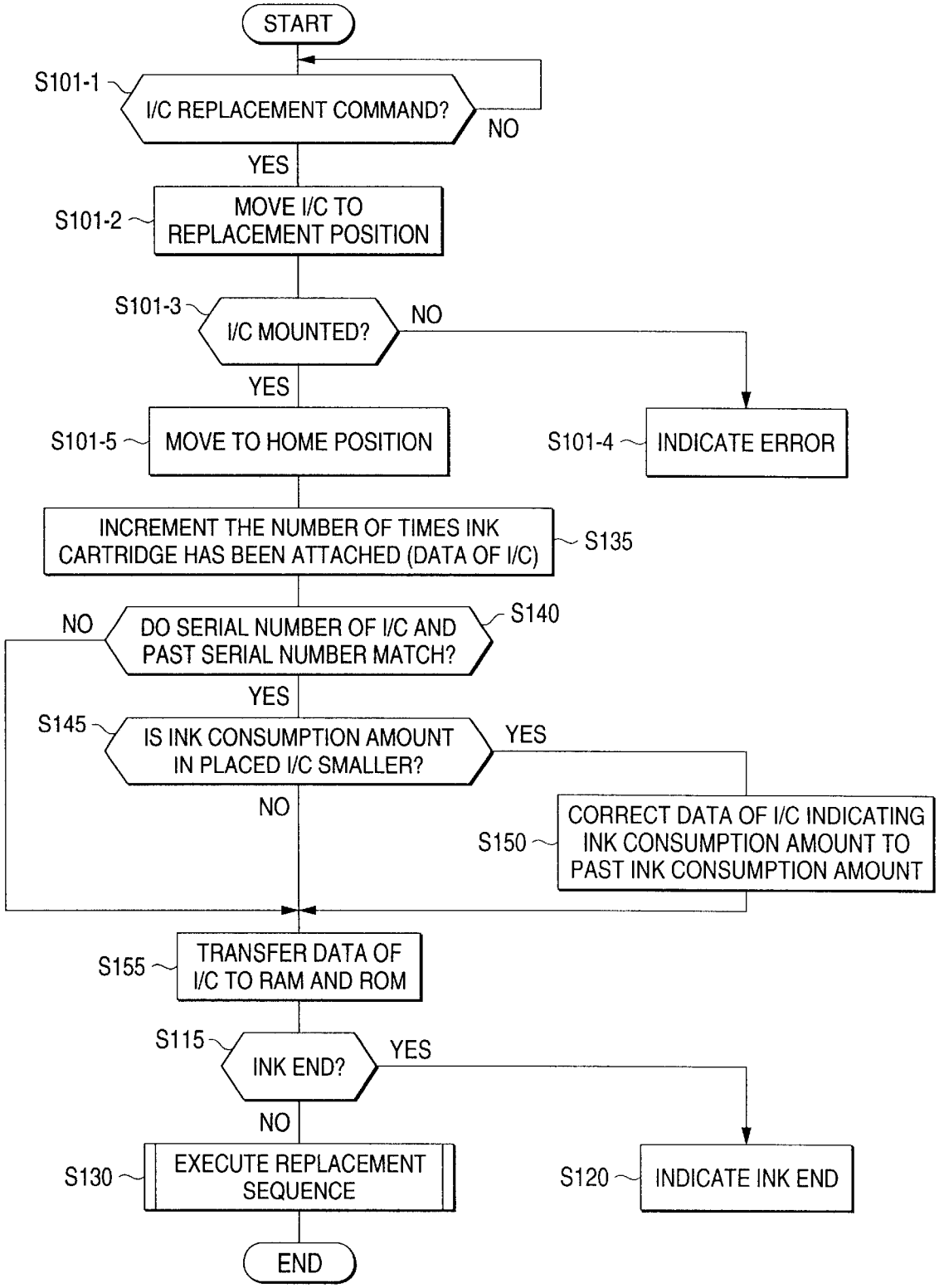
FIG. 19 is a flowchart to show yet another data check operation when the ink cartridge is replaced in the operation of the printer.

Similarly, the step S106 in the fifth method may be omitted. FIG. 19 shows a flow of a seventh method to determine the precise "ink consumption amount" in which the step 5106 is omitted. In the seventh method, the step 101 is divided into plural sub-steps S101-1 to S101-5. Upon user's operation of the ink cartridge replacement command switch IC on the panel 8 for the purpose of initiating the replacement of the ink cartridge 6, 7, the ink replacement command is given at the step S101-1 to move the carriage 11 to an ink cartridge replacement position (S101-2) After a predetermined time period has passed, it is detected at step S101-3 as to whether or not the ink cartridge 6, 7 is placed in the carriage 11. If the cartridge 6, 7 has not been placed in the carriage 11, an error is displayed to inform the user that. the cartridge 6, 7 should be place (step S101-4).

After the cartridge 6, 7 surely placed in the carriage 11 is confirmed, the carriage 11 is moved to a home position (step S101-5), and then the information on the number of times the cartridge 6, 7 is placed, stored in the storage device 53, is incremented and updated at step S135 ((1), (4) of FIG. 16A). Thereafter, the same steps S140, S145, S150, S155, S115, S130 and/or S120 as those of the fifth method are executed.

Note that the term printer or ink jet printer used in the specification and claims is intended to encompass not only an ink jet printer but also any types of machines, such as a copy machine and a facsimile machine, which can execute printing using an ink jet type head.

Further, the term storage system or storage medium used in the specification and claims is intended to encompass not only a semi-conductor storage system but also any types of storage systems such as a magnetic storage system and an optical storage system, which can store data therein.

What is claimed is:

1. A ink cartridge management system comprising:

ink cartridges, each having a first storage system storing therein information on ink consumption amount of a respective ink cartridge, and on at least one of identification of the respective ink cartridge, and time point at which the information on ink consumption amount is created;

a printer to which at least one of the ink cartridges is detachably mounted;

a second storage system storing therein as backup data the information of one or ones of the ink cartridges which have ever been mounted to the printer; and a CPU comparing the information stored in the first storage system of an ink cartridge, which is currently mounted to the printer, with the information stored in the second storage system to determine a precise ink consumption amount of the currently mounted ink cartridge.

2. The system of claim 1, wherein the CPU and the second storage system are provided in the printer.

3. The system of claim 1, wherein the CPU and the second storage system are provided in a host discrete from but communicating with the printer.

4. The system of claim 1, wherein the second storage system stores the information on at least one of identification and time point, and on ink consumption amount of the currently mounted ink cartridge when power for the printer is to be turned off.

5. The system of claim 1, wherein the second storage system stores the information on at least one of identification and time point and on ink consumption amount of the currently mounted ink cartridge when the currently mounted ink cartridge is to be replaced.

6. The system of claim 1, wherein the CPU compares the information stored in the first storage system with the information stored in the second storage system immediately after power for the printer is turned on.

7. The system of claim 1, wherein the CPU compares the information stored in the first storage system with the information stored in the second storage system immediately after an ink cartridge is mounted to the printer as the currently mounted ink cartridge.

8. The system of claim 1, wherein the CPU executes the comparison to determine whether or not the information on ink consumption amount of the currentlymounted ink cartridge, stored in the first storage system, with a newest one of the information on ink consumption amount of the ink cartridges, stored in the second storage system.

9. The system of claim 1, wherein the CPU executes the comparison to determine whether or not the information on time point, stored in the first storage system, with a newest one of the information on time point, stored in the second storage system.

10. The system of claim 1, wherein the CPU executes the comparison to determine whether or not the information on identification of the currently mounted ink cartridge is contained in the information on identification of one or ones of the ink cartridges which have ever been mounted to the printer.

11. A ink cartridge management system comprising:

printers, each having information on identification of a respective printer;

an ink cartridge mountable to the printers, the ink cartridge having a first storage system storing therein information on ink consumption amount of the ink cartridge, and on identification of a printer that is used with the ink cartridge when the information on the ink consumption amount is created;

a second storage system storing therein information on identification of a printer communicating with the second storage system; and a CPU comparing the information stored in the first storage system of the ink cartridge with the information stored in the second storage system to determine a precise ink consumption amount of the ink cartridge.

12. The system of claim 11, wherein the second storage system stores therein information on ink consumption amount of ink cartridges used together with the printer communicating with the second storage system.

13. A method of determining a precise ink consumption amount, comprising the steps of:

obtaining cartridge management data from a first storage device provided in an ink cartridge when the ink cartridge is mounted to a printer, or power for the printer on which the ink cartridge is mounted is turned on, the cartridge management data including ink consumption amount information and at least one of cartridge identification information and cartridge history information in connection with the ink cartridge;

obtaining host management data stored in a second storage device, the second storage device storing as the host management data ink consumption amount information and at least one of cartridge identification information and cartridge history information in connection with ink cartridges that have ever been mounted to the printer; and comparing at least one of the cartridge identification information and the cartridge history information contained in the cartridge management data with at least one of the cartridge identification information and cartridge history information contained in the host management data to determine whether the ink consumption amount information contained in the cartridge management data is correct or should be replaced with the ink consumption amount information contained in the host management data.

14. The method of claim 13, wherein:

the step of comparing includes searching the host management data to determine whether the cartridge identification information obtained from the first storage device is contained in the cartridge identification information obtained from the second storage device.

15. The method of claim 14, wherein:

the step of comparing further includes determining that the ink consumption amount information contained in the cartridge management data is correct if the cartridge identification information obtained from the first storage device is not contained in the cartridge identification information obtained from the second storage device.

16. The method of claim 14, wherein:

the step of comparing further includes determining whether a first ink consumption amount indicated by the ink consumption amount information obtained from the first storage device is larger than a second ink consumption amount indicated by the ink consumption amount information that is stored in the second storage device in connection with the cartridge identification information obtained from the first storage device if the cartridge identification information obtained from the first storage device is contained in the cartridge identification information obtained from the second storage device.

17. The method of claim 16, wherein:

the step of comparing further includes determining that the ink consumption amount information contained in the cartridge management data is correct if the first ink consumption amount is larger than the second ink consumption amount.

18. The method of claim 16, wherein:

the step of comparing further includes determining that the ink consumption amount information contained in the cartridge management data should be replaced with the ink consumption amount information contained in the host management data if the first ink consumption amount is not larger than the second ink consumption amount.

19. The method of claim 14, wherein:

the cartridge history information of the cartridge management data indicates a time point at which the ink consumption amount information of the cartridge management data is stored in the first storage system;

the cartridge history information of the host management data indicates a time point at which the ink consumption amount information of the host management data is stored in the second storage device in connection with each of the ink cartridges that have ever been mounted to the printer; and the step of comparing further includes determining whether or not a first time point indicated by the cartridge history information obtained from the first storage device is identical to a second time point indicated by the cartridge history information that is stored in the second storage device in connection with the cartridge identification information obtained from the first storage device if the cartridge identification information is contained in the cartridge identification information obtained from the second storage device.

20. The method of claim 19, wherein:

the step of comparing further includes determining that the ink consumption amount information contained in the cartridge management data should be replaced with the ink consumption amount information contained in the host management data if the first time point is identical to the second time point.

21. The method of claim 19, wherein:

the step of comparing further includes determining whether or not the first time point postdates the second time point if the first time point is not identical to the second time point.

22. The method of claim 21, wherein:

the step of comparing further includes determining that the ink consumption amount information contained in the cartridge management data is correct if the first time point postdates the second time point.

23. The method of claim 21, wherein:

the step of comparing further includes determining that the ink consumption amount information contained in the cartridge management data should be replacedwith the ink consumption amount information contained in the host management data if the first time point does not postdate the second time point.

24. The method of claim 14, wherein:

the cartridge history information of the cartridge management data indicates printers that have ever been used together with the ink cartridge;

the cartridge history information of the host management data indicates the printer on which the ink cartridge is mounted; and the step of comparing further includes determining whether the printer indicated by the cartridge history information of the host management data is contained in the printers indicated by the cartridge history information of the cartridge management data.

25. The method of claim 24, wherein:

the step of comparing further includes determining that the ink consumption amount information contained in the cartridge management data should be replaced with the ink consumption amount information contained in the host management data if the printer indicated by the cartridge history information of the host management data is contained in the printers indicated by the cartridge history information of the cartridge management data.

26. The method of claim 24, wherein:

the step of comparing further includes determining that the ink consumption amount information contained in the cartridge management data is correct if the printer indicated by the cartridge history information of the host management data is not contained in the printers indicated by the cartridge history information of the cartridge management data.

27. A method of determining a precise ink consumption amount in a case where whether a first ink cartridge having a first storage device is identical to a second ink cartridge having a second storage device and whether the second ink cartridge mounted to a first printer was used with another second printer are unclear, the method comprising the steps of:

storing first cartridge management data into the first storage device provided in the first ink cartridge when the first ink cartridge is detached from the first printer, or power for the first printer on which the first ink cartridge is mounted is turned off, the first cartridge management data including ink consumption amount information and at least one of cartridge identification information and cartridge history information in connection with the first ink cartridge;

copying at least part of the cartridge management data in a third storage device as host management data when the first ink cartridge is detached from the first printer or power for the first printer on which the first ink cartridge is mounted is turned off;

reading at least part of second cartridge management data from the second storage device provided in the second ink cartridge when the second ink cartridge is attached to the first printer, or power for the first printer on which the second ink cartridge is mounted is turned on, wherein the second cartridge management data was stored in the second storage device when the second ink cartridge was detached from the first or second printer, or when power for the first or second printer on which the second ink cartridge was mounted was turned off, the second cartridge management data including ink consumption amount information and at least one of cartridge identification information and cartridge history information in connection with the second ink cartridge;

comparing the ink consumption amount information of the second cartridge management data with the ink consumption amount information of the host management data.

28. The method of claim 27, wherein:

the step of comparing includes determining that the ink consumption amount information of the second cartridge management data is correct if the ink consumption amount of the second cartridge management data is identical to the ink consumption amount information of the host management data.

29. The method of claim 27, wherein:

the step of comparing includes determining whether or not the cartridge identification information of the second cartridge management data is identical to the cartridge identification information of the host management data.

30. The method of claim 29, wherein:

the step of comparing further includes determining that the ink consumption amount information of the second cartridge management data is correct if the cartridge identification information of the second cartridge management data is not identical to the cartridge identification information of the host management data.

31. The method of claim 29, wherein:

the step of comparing further includes determining whether a first ink consumption amount indicated by the ink consumption amount information of the second cartridge management data is larger than a second ink consumption amount indicated by the ink consumption amount information of the host management data if the cartridge identification information of the second cartridges management data is identical to the cartridge identification information of the host management data.

32. The method of claim 31, wherein:

the step of comparing further includes determining that the ink consumption amount information of the second cartridge management data is correct if the first ink consumption amount is larger than the second ink consumption amount.

33. The method of claim 31, wherein:

the step of comparing further includes determining that the ink consumption amount information of the second cartridge management information should be replaced with the ink consumption amount information of the host management data if the first ink consumption amount is not larger than the second ink consumption amount.

34. An ink cartridge management system of managing the state of an ink cartridge placed in an ink jet printer, wherein:

the ink cartridge comprises a storage medium storing cartridge management data containing printer identification information of a printer or printers using the ink cartridge in the past;

the ink jet printer is connected to a host so that the ink jet printer and the host constitutes a print system;

the print system comprises:

a read system for reading the cartridge management data from the storage medium of the ink cartridge;

a determination system for determining an ink jet printer or ink jet printers using the ink cartridge in the past with reference to the printer identification information contained in the read cartridge management data;

an execution system for selecting, based on a result of determination by the determination system, for one from a plurality of management methods that are predetermined to manage the ink cartridge in accordance with the determined ink jet printer or printers, and executing the selected management method; and a write system for writing the printer management information into the storage medium of the ink cartridge.

35. The ink cartridge management system as claimed in claim 34, wherein:

the determination system determines that the printer identification information is not contained in the cartridge management data, that the printer identification information is the same as that of the ink jet printer of the print system, or that the printer identification information is different from that of the ink jet printer of the print system; and the execution system selects one from the plurality of management methods based on a result of the determination, and executes the selected management method.

36. The ink cartridge management system as claimed in claim 35, wherein:

the management method is a method to estimate an ink total consumption amount in the ink cartridge, and the ink total consumption amount is contained in the cartridge management data;

if the determination system determines that the printer identification information is not contained in the cartridge management data, the execution system estimates ink in the ink cartridge to be unconsumed, if the determination system determines that the printer identification information is the same as that of the ink jet printer of the print system, the execution system uses at least one of the cartridge management data and data managed in the print system to estimate a precise ink total consumption amount, and if the determination system determines that the printer identification information is different from that of the ink jet printer of the print system, the execution system estimates the ink total consumption amount contained in the cartridge management data to be precise.

37. An ink jet printer comprising:

a read system for reading, from a storage medium provided in an ink cartridge, cartridge management data containing printer identification information of a printerorprinters using the ink cartridge in the past;

a determination system for determining an ink jet printer or ink jet printers using the ink cartridge in the past with reference to the printer identification information contained in the read cartridge management data;

an execution system for selecting, based on a result of determination by the determination system, one from a plurality of management methods that are predetermined to manage the ink cartridge in accordance with the determined ink jet printer or printers, and executing the selected management method; and a write system for writing the printer identification information into the storage medium of the ink cartridge.

38. An ink cartridge used with the ink cartridge management system as claimed in any one of claims 34 to 36.

39. A computer-readable record medium recording a program for causing a computer to execute:

a read step of reading, from a storage medium contained in an ink cartridge, cartridge management data containing printer identification information of a printer or printers using the ink cartridge in the past;

a determination step of determining an ink jet printer or ink jet printers using the ink cartridge in the past with reference to the printer identification information contained in the read cartridge management data, and an execution step of selecting, based on a result of determination by the determination step, one from a plurality of management methods that are predetermined to manage the ink cartridge in accordance with the determined ink jet printer or printers, and executing the selected management method; and a write step of writing the printer identification information into the storage medium of the ink cartridge.

40. A system of estimating an ink consumption amount of an ink cartridge placed in an ink jet printer, wherein:

the ink cartridge comprises a storage medium storing cartridge management data containing information defining cartridge identification and ink consumption amount;

the ink jet printer is connected to a host so that the ink jet printer and the host constitutes a print system;

the print system comprises:

a read system for reading the cartridge management data from the storage medium of the ink cartridge;

a storage system for storing system management data containing information defining cartridge identification and ink consumption amount corresponding to each of one or more ink cartridges;

a retrieval system for retrieving the system management data corresponding to the ink cartridge placed in the ink jet printer with reference to the information defining the cartridge identification contained in the read cartridge management data; and, a determination system for comparing the information defining the ink consumption amount contained in the cartridge management data with the information defining the ink consumption amount contained in the retrieved system management data, and determining information defining a current ink consumption amount.

41. The ink consumption amount estimating system as claimed in claim 40, further comprising:

a write system for writing the determined information defining the current ink total consumption amount into the storage medium of the ink cartridge.

42. The ink consumption amount estimating system as claimed in claim 40, wherein if the data comparison result indicates that an ink total consumption amount defined by the cartridge management data is greater than an ink total consumption amount defined by the retrieved system management data, the determination system in the print system determines that the ink total consumption amount defined by the cartridge management data is a current ink total consumption amount, and if the data comparison result indicates that the ink total consumption amount defined by the cartridge management data is less than or equal to the ink totalconsumption amount definedby the retrieved system management data, the determination system in the print system determines that the ink total consumption amount defined by the system management data is the current ink total consumption amount.

43. The ink consumption amount estimating system as claimed in claim 40, wherein information defining date and time at which the ink cartridge was last used is contained in the cartridge management data and the system management data, and the determination system in the print system compares the date and time defined by the cartridge management data with the date and time defined by the system management data, and determines, based on the comparison result, which of an ink total consumption amount defined by the cartridge management data and an ink total consumption amount defined by the system management data is to be selected as a current ink total consumption amount.

44. The ink consumption amount estimating system as claimed in claim 40, wherein the print system comprises:

a date and time storage system for storing date and time when print processing terminates in the ink jet printer, when power for the ink jet printer is turned off, or when the ink cartridge is detached; and a head recovery control system for checking a time interval between the stored date and time and recovery operation date and time when printer head recovery operation of the ink jet printer is performed, and controlling contents of the printer head recovery operation in accordance with the time interval.

45. An ink cartridge used with the ink consumption amount estimating system as claimed in any one of claims 40 to 44.

46. A host device connectable to an ink jet printer, comprising:

a storage system for storing host management data containing information defining cartridge identification and ink consumption amount corresponding to each of one or more ink cartridges adaptable to the ink jet printer;

a receiving system for receiving read cartridge management data containing information defining cartridge identification and ink consumption amount stored in a storage medium provided in an ink cartridge;

a retrieval system for retrieving the host management data corresponding to the ink cartridge placed in the ink jet printer with reference to the information defining the cartridge identification contained in the received cartridge management data;

a determination system for comparing the information defining the ink consumption amount contained in the cartridge management data with the information defining the ink consumption amount contained in the retrieved system management data, and determining information defining a current ink consumption amount; and a sending system for sending the determined information defining the current ink consumption amount so that the determined information defining the current ink consumption amount can be written into the storage medium of the ink cartridge.

47. The host device as claimed in claim 46, wherein if the data comparison result indicates that an ink total consumption amount defined by the cartridge management data is greater than an ink total consumption amount defined by the retrieved host management data, the determination system determines that the ink total consumption amount defined by the cartridge management data is a current ink total consumption amount, and if the data comparison result indicates that the ink total consumption amount defined by the cartridge management data is less than or equal to the ink total consumption amount defined by the retrieved host management data, the determination system determines that the ink total consumption amount defined by the host management data is the current ink total consumption amount.

48. An ink jet printer to which an ink cartridge having a storage medium storing cartridge management data containing information defining cartridge identification and ink consumption amount is placed, the ink jet printer comprising:

a read system for reading the cartridge management data from the storage medium of the ink cartridge;

a storage system for storing system management data containing information defining cartridge identification and ink consumption amount corresponding to each of one or more ink cartridges;

a retrieval system for retrieving the system management data corresponding to the ink cartridge placed in the ink jet printer with reference to the information defining the cartridge identification contained in the read cartridge management data; and a determination system for comparing the information defining the ink consumption amount contained in the cartridge management data with the information defining the ink consumption amount contained in the retrieved system management data, and determining information defining a current ink consumption amount.

49. The ink jet printer as claimed in claim 48, further comprising:

a write system for writing the determined information defining the current ink consumption amount into the storage medium of the ink cartridge.

50. An ink jet printer connectable to ahost device, to which an ink cartridge having a storage medium storing cartridge management data containing information defining cartridge identification and ink consumption amount is placed, the inkjet printer comprising:

a read system for reading the cartridge management data from the storage medium of the ink cartridge;

a sending system for sending the read cartridge management data to the host device, the host device including a storage system for storing system management data containing information defining cartridge identification and ink total consumption amount corresponding to each of one or more ink cartridges, a retrieval system for retrieving the system management data corresponding to the ink cartridge placed in the ink jet printer with reference to the information defining the cartridge identification contained in the sent cartridge management data, a determination system for comparing the information defining the ink consumption amount contained in the cartridge management data with the information defining the ink consumption amount contained in the retrieved system management data, and determining information defining a current ink consumption amount, and a sending system for sending the determined information defining the current ink consumption amount to the inkjet printer; and a receiving system for receiving the determined information defining the ink consumption amount from the host device;

a write system for writing the received information defining the current ink consumption amount into the storage medium of the ink cartridge.

51. The ink jet printer as claimed in claim 48 or 50, wherein if the data comparison result indicates that an ink total consumption amount defined by the cartridge management data is greater than an ink total consumption amount defined by the retrieved system management data, the determination system determines that the ink total consumption amount defined by the cartridge management data is a current ink total consumption amount, and if the data comparison result indicates that the ink total consumption amount defined by the cartridge management data is less than or equal to the ink total consumption amount defined by the retrieved system management data, the determination system determines that the ink total consumption amount defined by the system management data is the current ink total consumption amount.

52. An ink consumption amount estimating method comprising:

a read step of reading cartridge management data containing information defining cartridge identification and ink consumption amount from a storage medium of an ink cartridge;

a storage step of storing system management data containing information defining cartridge identification and ink consumption amount corresponding to each of one or more ink cartridges;

a retrieval step of retrieving the system management data corresponding to the ink cartridge placed in the ink jet printer with reference to the information defining the cartridge identification contained in the read cartridge management data;

a determination step of comparing the information defining the ink consumption amount contained in the cartridge management data with the information defining the ink consumption amount contained in the retrieved system management data, and determining information defining a current ink consumption amount; and a write step of writing the determined information defining the current ink consumption amount into the storage medium of the ink cartridge.

53. A computer-readable record medium recording a program for causing a computer to execute:

a receiving step of receiving read cartridge management data containing information defining cartridge identificationand ink consumption amount from a storage medium of an ink cartridge;

a storage step of storing system management data containing information defining cartridge identification and ink consumption amount corresponding to each of one or more ink: cartridges;

a retrieval step of retrieving the system management data corresponding to the ink cartridge placed in the ink jet printer with reference to the information defining the cartridge identification contained in the read cartridge management data;

a determination step of comparing the information defining the ink consumption amount contained in the cartridge management data with the information defining the ink consumption amount contained in the retrieved system management data, and determining information defining a current ink consumption amount; and a sending step of sending the determined information defining the current ink consumption amount to write the determined information defining the current ink consumption amount into the storage medium of the ink cartridge.

54. An ink jet printer comprising an ink jet record head and a control system for controlling the ink jet record head in accordance with print data, the ink jet printer being adapted to receive an ink cartridge for supplying ink to the ink jet record head, the ink cartridge having a storage system storing at least identification data for identifying the ink cartridge and data concerning an ink remaining amount, and the storage system including an electrically writable or rewritable storage system, wherein:

a cartridge data storage system is provided for storing identification data of an ink cartridge and data concerning ink remaining amount;

the control system compares, just after power is turned on or just after an ink cartridge is placed as a currently placed ink cartridge, data concerning ink remaining amount stored in a storage system of the currently placed ink cartridge with data concerning ink remaining amount in an ink cartridge placed just before the previous power off time or before the ink cartridge is removed, which is stored in the cartridge data storage system, and corrects the data concerning the ink remaining amount in the storage system of the currently ink cartridge if necessary.

55. The ink jet printer as claimed in claim 54, wherein if a match is not found as a result of comparing the data concerning the ink remaining amounts, the ink cartridge identification data in the storage system is compared with the identification data stored in the cartridge data storage system and if they match, the data concerning the ink remaining amount in the storage system is corrected based on the data concerning the ink remaining amount stored in the cartridge data storage system.

56. The ink jet printer as claimed in claim 54, wherein if a match is not found as a result of comparing the data concerning the ink remaining amounts, the ink remaining amount in the ink cartridge is determined and if ink end is not detected, the ink cartridge identification data in the storage system is compared with the identification data stored in the cartridge data storage system and if they match, the data concerning the ink remaining amount in the storage system is corrected based on the data concerning the ink remaining amount stored in the cartridge data storage system.

57. The ink jet printer as claimed in claim 54, wherein if a match is not found as a result of comparing the data concerning the ink remaining amounts, the ink cartridge identification data in the storage system is compared with the identification data stored in the cartridge data storage system and if they match, based on the data with the smaller ink remaining amount, the data concerning the other ink remaining amount is corrected.

58. The ink jet printer as claimed in any one of claims 54 to 57, wherein the cartridge data storage system includes a writable or rewritable storage system.

59. An ink jet printer comprising an ink jet record head, an ink cartridge for supplying ink to the ink jet record head, the ink cartridge having a storage system storing at least identification data for identifying the ink cartridge and data concerning the ink remaining amount, and a control system for controlling the ink jet record head in accordance with print data, the ink jet printer further comprising:

a cartridge data storage system for storing at least the identification data and the data concerning the ink remaining amount stored in the storage system of the ink cartridge while updating a plurality of the most recent pieces of the data in sequence.

60. An ink jet printer comprising an ink jet record head and a control system for controlling the ink jet record head in accordance with print data, the ink jet printer being adapted to receive at least one of ink cartridges each for supplying ink to the ink jet record head, each of the ink cartridges having a storage system storing at least identification data for identifying the respective ink cartridge and data concerning an ink remaining amount of the respective ink cartridge, and the storage system including an electrically writable or rewritable storage-system, wherein:

a cartridge data storage system is provided for storing identification data of ink cartridges and data concerning ink remaining amounts in relation to the ink cartridges;

the control system compares, just after power is turned on or just after an ink cartridge is placed as a currently placed ink cartridge, identification data stored in a storage system of the currently placed ink cartridge with identification data of the ink cartridges, stored in the cartridge data storage system and;

if the identification data stored in the cartridge data storage system contain first identification data identical to the identification data of the currently placed ink cartridge, the control system corrects the data concerning the ink remaining amount in the storage system of the currently ink cartridge with data concerning the ink remaining amount related to the first identification data.

61. The ink jet printer as claimed in claim 60, wherein:

the control system determines the ink remaining amount of the currently placed ink cartridge;

if an ink end is not determined, the control system compares the identification data stored in the storage system of the currently placed ink cartridge with identification data of the ink cartridges, stored in the cartridge data storage system;

if the identification data stored in the cartridge data storage system contain first identification data identical to the identification data of the currently placed ink cartridge, the control system corrects the data concerning the ink remaining amount in the storage system of the currently ink cartridge with data concerning the ink remaining amount related to the first identification data.

62. The ink jet printer as claimed in claim 60, wherein if a result of comparison of data concerning the ink remaining amounts indicates that an ink remaining amount defined by data stored in the storage system is larger an ink remaining amount defined by data stored in the cartridge data storage system, data stored in the storage system is corrected with the data stored in the cartridge data storage system.

63. The ink jet printer as claimed in any one of claims 60 to 62, wherein the cartridge data storage system includes a writable or rewritable, nonvolatile storage system.

64. An ink cartridge management method for an ink cartridge adapted to be used with printers, each having information on identification of a respective printer, the method comprising the steps of:

reading, from a first storage system of an ink cartridge, information on ink consumption amount of the ink cartridge and on identification of a printer that is used with the ink cartridge when the information on the ink consumption amount is created;

reading, from a second storage system, information on identification of a printer communicating with the second storage system; and comparing the information read from the first storage system of the ink cartridge with the information read from the second storage system to determine a precise ink consumption amount of the ink cartridge.

65. A printer system comprising:

an ink cartridge having a storage medium storing cartridge management data containing information defining cartridge identification and ink consumption amount;

a read system for reading the cartridge management data from the storage medium of the ink cartridge;

a storage system for storing system management data containing information defining cartridge identification and ink consumption amount corresponding to each of one or more ink cartridges;

a retrieval system for retrieving the system management data corresponding to the ink cartridge placed in the ink jet printer with reference to the information defining the cartridge identification contained in the read cartridges management data; and a determination system for comparing the information defining the ink consumption amount contained in the cartridge management data with the information defining the ink consumption amount contained in the retrieved system management data, and determining information defining a current ink consumption amount.

66. An ink cartridge management method, comprising the steps of:

reading, from a storage medium of an ink cartridge, cartridge management data containing information defining cartridge identification and ink consumption amount;

checking a storage system with reference to the information defining the cartridge identification contained in the read cartridge management data to obtain system management data corresponding to the ink cartridge; and comparing the information defining the ink consumption amount contained in the cartridge management data with information defining ink consumption amount contained in the obtained system management data to determine information defining a current ink consumption amount of the ink cartridge.

* * * * *